US006815135B2

(12) United States Patent
Morikawa et al.

(10) Patent No.: US 6,815,135 B2
(45) Date of Patent: Nov. 9, 2004

(54) ELECTROPHOTOGRAPHIC PHOTOSENSITIVE MEMBER, PROCESS CARTRIDGE AND ELECTROPHOTOGRAPHIC APPARATUS

(75) Inventors: Yosuke Morikawa, Kanagawa (JP); Tatsuya Ikezue, Kanagawa (JP); Kouichi Nakata, Shizuoka (JP); Kimihiro Yoshimura, Kanagawa (JP); Daisuke Tanaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 10/321,454

(22) Filed: Dec. 18, 2002

(65) Prior Publication Data

US 2003/0175604 A1 Sep. 18, 2003

(30) Foreign Application Priority Data

Dec. 21, 2001 (JP) ..... 2001-389239

(51) Int. Cl.[7] ..... G03G 5/14
(52) U.S. Cl. ..... 430/66; 430/67; 399/159
(58) Field of Search ..... 430/66, 67; 399/159; 427/430.1; 118/503

(56) References Cited

U.S. PATENT DOCUMENTS

| | | | | |
|---|---|---|---|---|
| 4,618,559 A | * | 10/1986 | Yashiki | 430/127 |
| 5,606,401 A | | 2/1997 | Yano | 355/219 |
| 6,503,571 B1 | * | 1/2003 | Bonino et al. | 427/430.1 |

FOREIGN PATENT DOCUMENTS

| | | | |
|---|---|---|---|
| GB | 1264175 | 2/1972 | G03G/5/04 |
| JP | 59-026044 | 2/1984 | |
| JP | 5-173350 | 7/1993 | |
| JP | 7-005748 | 1/1995 | |

OTHER PUBLICATIONS

Patent Abstracts of Japan 10, 380 (P—528) 1986.

Patent Abstracts of Japan 6, 252 (161) 1982.

Patent Abstracts of Japan 14, 360 (P–1088) 1990.

Patent Abstracts of Japan 12, 074, 1988.

* cited by examiner

*Primary Examiner*—John L Goodrow
(74) *Attorney, Agent, or Firm*—Fitzpatrick, Cella, Harper & Scinto

(57) ABSTRACT

In an electrophotographic photosensitive member comprising a conductive support, and provided thereon a charge generation layer, a charge transport layer and a protective layer in this order, the layer thickness $a_0$ ($\mu$m) of the charge transport layer at the middle portion of the conductive support in its generatrix direction, the layer thickness $b_0$ ($\mu$m) of the protective layer at the middle portion of the conductive support in its generatrix direction, the layer thickness a ($\mu$m) of the charge transport layer at a portion other than the middle portion and the layer thickness b ($\mu$m) of the protective layer at the portion other than the middle portion satisfy the following expression (1) in a region satisfying 0.8 ($\mu$m)$\leqq(a_0-a)\leqq$3.0 ($\mu$m):

$$b_0\times(a/a_0)^3\leqq b(\mu\text{m})\leqq b_0\times(a/a_0)^{1/4} \quad (1).$$

Also disclosed are a process cartridge and an electrophotographic apparatus which have such an electrophotographic photosensitive member.

11 Claims, 7 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

This invention relates to an electrophotographic photosensitive member, a process cartridge and an electrophotographic apparatus. More particularly, it relates to an electrophotographic photosensitive member having on a conductive support at least a charge generation layer, a charge transport layer and a protective layer in this order, and a process cartridge and an electrophotographic apparatus which have such an electrophotographic photosensitive member.

2. Related Background Art

In recent years, electrophotographic photosensitive members are required to be made further durable. For example, Japanese Patent Application Laid-open No. 5-173350 discloses that an electrophotographic photosensitive member having very good durability can be provided by forming on a photosensitive layer a protective layer which contains a curable resin. As another example, Japanese Patent Application Laid-open No. 7-5748 discloses what is called injection charging, in which electric charges are injected into a protective layer on a photosensitive layer without being accompanied with any substantial discharge.

Thus, it is one of very important techniques to form a protective layer on the photosensitive layer of an electrophotographic photosensitive member.

Meanwhile, as offices are made small-business and home-operable in recent years, electrophotographic apparatus such as copying machines and printers are required to be made small-size, and electrophotographic photosensitive members have a tendency of being made shorter in length in their generatrix direction.

Since, however, the width of a developing region in the generatrix direction of the electrophotographic photosensitive member depends on the size of a transfer material such as paper, the developing region itself can not be narrowed. Namely, the same paper-feed width or development width must be ensured using a shorter electrophotographic photosensitive member. Accordingly, it has come necessary to form images also in electrophotographic photosensitive member's end regions in which any images have not been formed in conventional cases.

However, end portions of photosensitive layers or protective layers tend to have non-uniform layer thickness. At the portions having non-uniform layer thickness, charging non-uniformity and sensitivity non-uniformity have tended to occur to make it difficult to form uniform images.

At present, from the viewpoint of good productivity of such layers, what is mostly employed as a coating method therefor is what is called the dip coating, in which a conductive support is plunged into a coating fluid (solution or dispersion) for each layer substantially vertically in the generatrix direction and then lifted up. In such dip coating, however, it has been very difficult to make the layer thickness at an end region equal to that at the middle portion; the former being layer thickness given immediately after the coating fluid for each layer begins to be coated, i.e., the layer thickness on the side where, as the support (cylinder) is lifted up, the coating fluid begins to be coated in the generatrix direction of the electrophotographic photosensitive member layer. This is because it is impossible to prevent the coating fluid perfectly from sagging immediately after the coating.

Especially in the case of the electrophotographic photosensitive member having a protective layer on a photosensitive layer, coating non-uniformity has tended to occur remarkably for the part corresponding to a larger number of layers than an electrophotographic photosensitive member not having any protective layer. Japanese Patent Application Laid-open No. 59-26044 discloses that more uniform images can be obtained by controlling the thickness of the charge generation layer and that of the charge transport layer. It, however, does not disclose any finding at all on the relationship between the protective layer and the photosensitive layer.

To make coating speed higher in order to improve productivity, it is also necessary to lower the concentration of solid content of the coating fluid. However, the coating fluid may more greatly sag with a decrease in the viscosity of the coating fluid, resulting in remarkable occurrence of coating non-uniformity.

Thus, although it is very difficult from the viewpoint of production techniques to obtain good images, it is required to achieve much higher image quality as color-image formation has been achieved in electrophotography and formation of minute images of as high as 1,200 dpi (dot per inch) has been achieved.

SUMMARY OF THE INVENTION

An object of the present invention is to provide an electrophotographic photosensitive member having very superior electrophotographic performance, in order to accomplish much smaller size, much lower cost and much higher image quality hereafter, on condition that any coating non-uniformity due to the sagging of coating fluid may occur when the electrophotographic photosensitive member is manufactured.

Another object of the present invention is to provide a process cartridge and an electrophotographic apparatus which have such an electrophotographic photosensitive member.

To achieve the above objects, the present invention provides an electrophotographic photosensitive member comprising a conductive support, and provided thereon a charge generation layer, a charge transport layer and a protective layer in this order, wherein;

the layer thickness $a_0$ ($\mu$m) of the charge transport layer at the middle portion of the conductive support in its generatrix direction, the layer thickness $b_0$ ($\mu$m) of the protective layer at the middle portion of the conductive support in its generatrix direction, the layer thickness a ($\mu$m) of the charge transport layer at a portion other than the middle portion and the layer thickness b ($\mu$m) of the protective layer at the portion other than the middle portion satisfy the following expression (1) in a region satisfying $0.8\ (\mu m) \leqq (a_0 - a) \leqq 3.0\ (\mu m)$:

$$b_0 \times (a/a_0)^3 \leqq b(\mu m) \leqq b_0 \times (a/a_0)^{1/4} \quad (1).$$

The present invention also provides a process cartridge and an electrophotographic apparatus which have such an electrophotographic photosensitive member.

DETAILED DESCRIPTION OF THE PREFERRED EMBODIMENTS

In the present invention, the layer thickness $a_0$ (μm) of the charge transport layer at the middle portion of the conductive support in its generatrix direction, the layer thickness $b_0$ (μm) of the protective layer at the middle portion of the conductive support in its generatrix direction, the layer thickness a (μm) of the charge transport layer at a portion other than the middle portion and the layer thickness b (μm) of the protective layer at the portion other than the middle portion satisfy the following expression (1) in a region satisfying 0.8 (μm)≦($a_0$−a)≦3.0 (μm):

$$b_0\times(a/a_0)^3 \leqq b(\mu\text{m}) \leqq b_0\times(a/a_0)^{1/4} \quad (1).$$

Embodiments of the present invention are described below with reference to the drawings.

Figure 1:
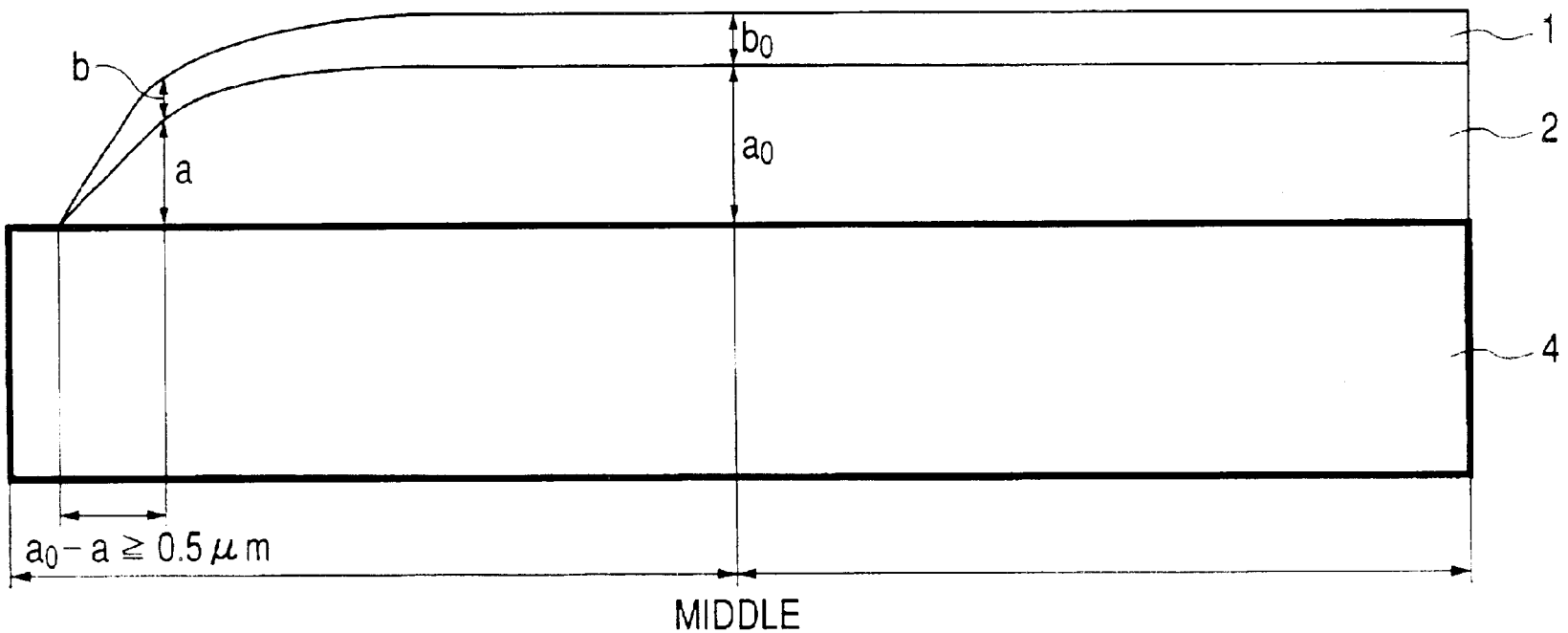
FIG. 1 is a diagrammatic view of a cross section of the electrophotographic photosensitive member of the present invention, cut in its generatrix direction.

FIG. 1 is a diagrammatic view of a cross section of the electrophotographic photosensitive member of the present invention, cut in its generatrix direction. As shown in FIG. 1, the electrophotographic photosensitive member of the present invention is an electrophotographic photosensitive member comprising a conductive support 4, and provided thereon a charge generation layer (not shown), a charge transport layer 2 and a protective layer 1 in this order. The charge generation layer and the charge transport layer constitute a photosensitive layer.

As can also be seen from FIG. 1, the region in which the layer thickness a (μm) of the charge transport layer at a portion other than the middle portion of the conductive support in its generatrix direction is smaller by at least 0.5 μm than the layer thickness $a_0$ (μm) of the charge transport layer at the middle portion is, where the dip coating is employed, the end region on the side where the coating fluid begins to be coated. Then, the protective layer is so formed that its layer thickness b (μm) at the position where the layer thickness of the charge transport layer is a (μm) satisfies the expression (1). This makes it able to solve the problems discussed above, and to provide an electrophotographic photosensitive member with which good images are obtainable.

In the present invention, the layer thickness b (μm) of the protective layer may preferably satisfy the following expression (2):

$$b_0\times(a/a_0)^2 \leqq b(\mu\text{m}) \leqq b_0\times(a/a_0)^{1/3} \quad (2).$$

The layer thickness b (μm) of the protective layer may preferably satisfy the above expressions (1) and (2) within the range of 10 to 100 mm as distance from the end region of the conductive support on the side where the coating fluid begins to be coated, preferably within the range from 12 mm as distance from the end region on the side where the coating fluid begins to be coated to the middle portion because generally the end region of the developing area is within such range.

As described above, in the present invention, the layer thickness $a_0$ (μm) of the charge transport layer at the middle portion of the conductive support in its generatrix direction and the layer thickness a (μm) of the charge transport layer at a portion other than the middle portion may preferably satisfy the following expression (3):

$$0.5(\mu\text{m}) \leqq (a_0-a) \quad (3).$$

Where the layer thickness of the charge transport layer is smaller than the layer thickness at the middle portion, the photosensitive member surface has a high light-area potential V1. In the case of reversal development, this makes images have low density. Such density non-uniformity may come conspicuous especially on images with an intermediate value such as halftone images, and may come more conspicuous on color images and highly minute images.

The present inventors have presumed that this image non-uniformity is caused by electric charges accumulated at the interface formed between the charge transport layer and the protective layer.

In recent years, research and development on protective layers of electrophotographic photosensitive members is making advances at a dizzying pace, but there is no change in that the interface is formed between the charge transport layer and the protective layer. This tends more strongly especially where a curable resin is used in the protective layer.

Electric charges generated in the charge generation layer move through the charge transport layer, thereafter reach the above interface, and thereafter enter the protective layer, where, in usual cases, some electric charges are considered to accumulate at the interface. The extent to which the surface potential becomes higher because of such accumulation of some electric charges depends on the layer thickness of the protective layer. The larger the layer thickness of the protective layer is, the more the surface potential is raised. Conversely, the smaller the layer thickness of the protective layer is, the less the surface potential is raised.

Accordingly, the present inventors have discovered that any surface potential non-uniformity caused by any layer thickness non-uniformity of the charge transport layer can be restrained by controlling the layer thickness of the protective layer so as to satisfy the relationship of the above expression (1), and have accomplished the present invention. The expressions (1) and (2) in the present invention are those derived empirically by the present inventors as a result of various studies made based on the above viewpoint.

The layer thickness can be controlled by adjusting the viscosity of the coating fluid, the conductive support lift-up speed from the coating fluid, the position of starting the coating and so on, but in the present invention the means for forming the layer thickness is by no means limited to them.

The layer thickness $b_0$ (μm) of the protective layer at the middle portion of the conductive support in its generatrix direction may preferably be from 0.5 μm to 5.5 μm, and particularly preferably from 1 μm to 4 μm. If this layer thickness is less than 0.5 μm, the effect itself of providing the protective layer may be obtained with difficulty. If it is more than 5.5 μm, the residual potential tends to come higher.

Meanwhile, the layer thickness $a_0$ (μm) of the charge transport layer at the middle portion of the conductive support in its generatrix direction may preferably be from 5 μm to 40 μm, and particularly preferably from 7 μm to 30 μm. If this layer thickness is less than 5 μm, the electric-field strength applied to the electrophotographic photosensitive member may come too high. If it is more than 40 μm, highly minute images may be obtained with difficulty.

In the present invention, the layer thickness of the protective layer and that of the charge transport layer are measured in the following way: Spots at which the layer thickness is to be measured are marked, and the photosensitive member is cut in about 5 mm square in the shape embracing each spot. Samples obtained are etched by means of Focused Ion Beam (FIB) FB-2000C (manufactured by Hitachi Ltd.). Thereafter, their sections are observed at an angle of 45°, and correction is made for the angle to determine the layer thickness of each layer. In particular, the layer thickness of each layer at the middle portion of the conductive support is important in the present invention, and hence samples are prepared for four spots in the peripheral direction at the middle portion, and their average value for each layer is represented by $a_0$ (μm) and $b_0$ (μm) each. Also, the charge transport layer's layer thickness used as the standard for controlling the protective layer's layer thickness is measured with an instantaneous multiple photometric system MCPD-2000 (trade name; manufactured by Ohtsuka Denshi K.K.) which utilizes interference of light.

The protective layer of the electrophotographic photosensitive member according to the present invention may preferably be a layer containing a binder resin and at least one of conductive particles and a charge-transporting material.

As the binder resin for the protective layer, curable resins are preferred. In particular, phenolic resins, epoxy resins and siloxane resins are more preferred. Still in particular, phenolic resins are preferred because the electrical resistance of the protective layer may less undergo environmental variations. Then, particularly more preferred are heat-curable resol type phenolic resins in view of advantages that they can provide a high surface hardness, promise superior wear resistance and also afford superior dispersibility for fine particles and superior stability after their dispersion.

Curable phenolic resins are resin obtained commonly by the reaction of phenolics with formaldehyde.

The phenolic resins have two types, and are divided into a resol type obtained by the reaction of a phenolic with formaldehyde, the latter being used in excess in respect to the former, in the presence of an alkali catalyst, and a novolak type obtained by the reaction of a phenolic with formaldehyde, the former being used in excess in respect to the latter, in the presence of an acid catalyst.

The resol type is soluble in alcohol type solvents and also in ketone type solvents. It undergoes three-dimensionally cross-linking polymerization upon heating, and comes into a cured product. As for the novolak type, it usually does not cure when heated as it is, but forms a cured product upon heating with addition of a formaldehyde source such as paraformaldehyde or hexamethylenetetramine.

Commonly and industrially, the resol type is utilized in coating materials, adhesives, castings and laminating varnishes. The novolak type is chiefly utilized in molding materials and binders.

In the present invention, either of the resol type and the novolak type may be used as the phenolic resins. In view of the ability to cure without addition of any curing agent and the operability as coating materials, it is preferable to use the resol type.

Where the phenolic resins are used in the present invention, any of phenolic resins may be used alone or in the form of a mixture of two or more. It is also possible to use the resol type and the novolak type in combination. Also, any known phenolic resins may be used.

Resol type phenolic resins are usually produced by reacting phenolic compounds with aldehyde compounds in the presence of an alkali catalyst.

Chief phenolic compounds to be used may include, but are not limited to, phenol, cresol, xylenol, para-alkylphenols, para-phenylphenol, resorcin and bisphenols. The aldehyde compounds may also include, but are not limited to, formaldehyde, paraformaldehyde, furfural and acetaldehyde.

These phenolic compounds and aldehyde compounds may be allowed to react in the presence of an alkali catalyst to produce any of monomers of monomethylolphenols, dimethylolphenols or trimethylolphenols, mixtures of these, or those obtained by making them into oligomers, and mixtures of these monomers and oligomers. Of these, relatively large molecules having about 2 to 20 repeating units of molecular structure are the oligomers, and those having a single unit are the monomers.

The alkali catalyst to be used may include metal type alkali compounds and amine compounds. The metal type alkali compounds may include, but are not limited to, alkali metal or alkaline earth metal hydroxides such as sodium hydroxide, potassium hydroxide and calcium hydroxide. The amine compounds may include, but are not limited to, ammonia, hexamethylenetetramine, trimethylamine, triethylamine and triethanolamine.

In the present invention, taking account of variations of electrical resistance in an environment of high humidity, amine compounds may preferably be used, and, taking account of other electrophotographic performances, may also be used in the form of a mixture with any of the metal type alkali compounds.

The protective layer of the electrophotographic photosensitive member according to the present invention may preferably be formed by coating on the photosensitive layer a coating solution prepared by dissolving the curable phenolic resin in, or diluting it with, a solvent or the like, whereby polymerization reaction takes place upon heating after coating and a cured layer is formed. The form of polymerization is that the reaction proceeds by addition and condensation caused by heating, where the protective layer is formed by coating, followed by heating to cause polymerization reaction to take place to form a polymeric cured layer in which the resin has cured.

Incidentally, in the present invention, what is meant by "the resin has cured" is that resin stands insoluble even when the resin is wetted with an alcohol solvent such as methanol or ethanol.

The conductive particles for the protective layer have an auxiliary function to control the volume resistivity of the protective layer, and need not necessarily be used if unnecessary.

The conductive particles usable in the protective layer of the electrophotographic photosensitive member according to the present invention may include metal particles and metal oxide particles.

The metal particles may include aluminum, zinc, copper, chromium, nickel, silver and stainless steel particles, or particles of plastic on the surfaces of which any of these metals has been vacuum-deposited. The metal oxide particles may include zinc oxide, titanium oxide, tin oxide, antimony oxide, indium oxide, bismuth oxide, tin-doped indium oxide, antimony- or tantalum-doped tin oxide, and antimony-doped zirconium oxide particles.

Any of these may be used alone or may be used in combination of two or more types. When used in combination of two or more types, they may merely be blended or may be made into a solid solution or a fused solid.

In the present invention, among the conductive particles described above, the use of metal oxides is preferred in view of the transparency. Of these metal oxides, the use of tin oxide is further particularly preferred. The tin oxide may be, for the purpose of improving dispersibility and liquid stability, one having been subjected to surface treatment described later, or may be, for the purpose of improving resistance controllability, one having been doped with antimony or tantalum.

The conductive particles for the protective layer may preferably have an average particle diameter of 0.3 $\mu$m or less, and particularly 0.1 $\mu$m or less, from the viewpoint of transparency of the protective layer. On the other hand, from the viewpoint of dispersibility and dispersion stability, they may preferably have an average particle diameter of 0.001 $\mu$m or more.

From the viewpoint of film strength of the protective layer, the protective layer comes weaker with an increase in the quantity of the conductive particles. Accordingly, the conductive particles may preferably be in a small quantity as long as the volume resistivity and residual potential of the protective layer are tolerable.

The protective layer of the electrophotographic photosensitive member according to the present invention may also preferably be a layer containing lubricating particles The lubricating particles for the protective layer may preferably include fluorine-atom-containing resin particles, silicone resin particles, silica particles and alumina particles, and more preferably be fluorine-atom-containing resin particles. Also, two or more kinds of these may be blended.

The fluorine-atom-containing resin particles may include particles of tetrafluoroethylene resin, trifluorochloroethylene resin, hexafluoroethylene propylene resin, vinyl fluoride resin, vinylidene fluoride resin, difluorodichloroethylene resin and copolymers of these, any one or more of which may preferably appropriately be selected. Tetrafluoroethylene resin particles and vinylidene fluoride resin particles are particularly preferred.

The molecular weight and particle diameter of the lubricating particles may appropriately be selected, without any particular limitations. Preferably, they may have a molecular weight of from 3,000 to 5,000,000, and an average particle diameter of from 0.01 $\mu$m to 10 $\mu$m, and more preferably from 0.05 $\mu$m to 2.0 $\mu$m.

Inorganic particles such as silica particles and alumina particles do not function as the lubricating particles as particles alone in some cases. However, studies made by the present inventors have revealed that the dispersing and adding of these can make the protective layer have a larger surface roughness, and consequently can make the protective layer have an improved lubricity. In the present invention, the lubricating particles are meant to include particles capable of providing lubricity.

When the conductive particles and the lubricating particles such as fluorine-atom-containing resin particles are dispersed together in a resin solution, in order to make these particles not undergo mutual agglomeration, the fluorine-atom-containing compound may be added at the time the conductive particles are dispersed, or the conductive particles may be surface-treated with the fluorine-containing compound.

Compared with a case in which any fluorine-atom-containing compound is not added, the addition of the fluorine-atom-containing compound to the conductive particles or the surface treatment of the latter with the former brings about a dramatic improvement in dispersibility and dispersion stability of the conductive particles and fluorine-atom-containing resin particles in the resin solution.

The fluorine-atom-containing resin particles may also be dispersed in a liquid dispersion in which the fluorine-atom-containing compound has been added and the conductive particles have been dispersed, or in a liquid dispersion in which the surface-treated conductive particles have been dispersed. This enables preparation of a protective-layer coating fluid free of any formation of secondary particles of dispersed particles, very stable with time and having a good dispersion.

The fluorine-atom-containing compound may include fluorine-containing silane coupling agents, fluorine-modified silicone oils and fluorine type surface-active agents. Examples of preferred compounds are given below. In the present invention, examples are by no means limited to these compounds.

Examples of fluorine-containing silane coupling agents $CF_3CH_2CH_2Si(OCH_3)_3$
$C_4F_9CH_2CH_2Si(OCH_3)_3$
$C_6F_{13}CH_2CH_2Si(OCH_3)_3$
$C_8F_{17}CH_2CH_2Si(OCH_3)_3$
$C_8F_{17}CH_2CH_2Si(OCH_2CH_2OCH_3)_3$
$C_{10}F_{21}Si(OCH_3)_3$
$C_8F_{13}CONHSi(OCH_3)_3$
$C_8F_{17}CONHSi(OCH_3)_3$
$C_7F_{16}CONHCH_2CH_2CH_2Si(OCH_3)_3$
$C_7F_{15}CONHCH_2CH_2CH_2Si(OC_2H_5)_3$
$C_7F_{15}COONHCH_2CH_2CH_2Si(OCH_3)_3$
$C_7F_{15}COSNHCH_2CH_2CH_2Si(OCH_3)_3$
$C_7F_{15}SO_2NHCH_2CH_2CH_2Si(OC_2H_5)_3$ $C_8F_{17}SO_2N(CH_2CH_2CH_3)CH_2CH_2CH_2Si(OCH_3)_3$ $C_8F_{17}CH_2CH_2SCH_2CH_2Si(OCH_3)_3$
$C_{10}F_{21}CH_2CH_2SCH_2CH_2Si(OCH_3)_3$ $C_7F_{15}CONHCH_2CH_2N(COC_7F_{15})CH_2CH_2CH_2Si(OCH_3)_3$ $C_7H_{15}SO_2NHCH_2CH_2N(SO_2C_8F_{17})CH_2CH_2CH_2Si(OCH_3)_3$ Examples of fluorine-modified silicone oils

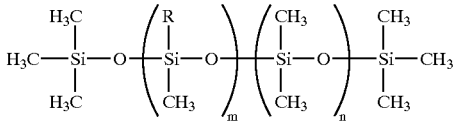

R: —$CH_2CH_2CF_3$ m and n: positive integers

Examples of fluorine type surface-active agents $X—SO_2NRCH_2COOH$
$X—SO_2NRCH_2CH_2O(CH_2CH_2O)_nH$
$X—SO_2N(CH_2CH_2CH_2OH)_2$ -continued $X—RO(CH_2CH_2O)_nH$
$X—(RO)_nH$
$X—(RO)_nR$ $X—SO_2NRCH_2CHCH_2$ (O)

$X—COOH$, $X—CH_2CH_2COOH$
$X—ORCOOH$
$X—ORCH_2COOH$, $X—SO_3H$
$X—ORSO_3H$, $X—CH_2CH_2OH$ $X—CH_2OCH_2CHCH_2$ (O)

$X—CH_2CH_2OCH_2CHCH_2$ (O)

$X—CO_2CH_2CHCH_2$ (O)

R: alkyl group, aryl group or aralkyl group.
X: fluorocarbon group such as $—CF_3$, $—C_4F_8$ or $—C_8F_{17}$.
n: 5, 10 or 15

As a method for the surface treatment of the conductive particles, the conductive particles and the surface-treating agent may be mixed and dispersed in a suitable solvent to make the surface-treating agent adhere to the conductive-particle surfaces. They may be dispersed by using a usual dispersion means such as a ball mill or a sand mill. Next, the solvent may be removed from the resultant liquid dispersion to make the surface-treating agent fix to the conductive-particle surfaces.

After this treatment, heat treatment may further optionally be made. Also, in the surface-treating dispersion, a catalyst for accelerating the reaction may be added. Still also, the conductive particles having been surface-treated may further optionally be subjected to pulverization treatment.

The proportion of the fluorine-atom-containing compound to the conductive particles is influenced by the particle diameter, shape and surface area of the particles to be treated, and the former may preferably be in an amount of from 1 to 65% by weight, and more preferably from 1 to 50% by weight, based on the total weight of the latter conductive particles having been surface-treated.

In the present invention, in order to provide a protective layer having a higher environmental stability, a siloxane compound having structure represented by the following Formula (1) may further be added at the time the conductive particles are dispersed, or conductive particles having been surface-treated with the siloxane compound having structure represented by the following Formula (1) may further be mixed. This enables formation of the protective layer having much higher environmental stability.

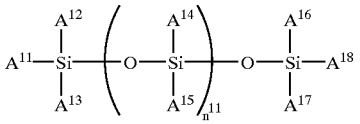

(1)

In Formula (1), $A^{11}$ to $A^{18}$ are each independently a hydrogen atom or a methyl group, provided that the proportion of the total number (b) of the hydrogen atoms in the total number (a) of A's, b/a, ranges from 0.001 or more to 0.5 or less; and $n^{11}$ is an integer of 0 or more.

This siloxane compound may be added to the conductive particles, followed by dispersion, or conductive metal oxide particles surface-treated with this siloxane compound may be dispersed in a binder resin dissolved in a solvent. This enables preparation of a protective-layer coating fluid free of any formation of secondary particles of dispersed particles, more stable with time and having a better dispersion. Also, the protective layer formed using such a coating fluid can have a high transparency, and a film having especially good environmental resistance can be obtained.

There are no particular limitations on the molecular weight of the siloxane compound having structure represented by the above Formula (1). However, when the conductive particles are surface-treated with it, it is better for the compound not to have too a high viscosity in view of the readiness of surface treatment. It may preferably have a weight-average molecular weight of from 100 to 50,000, and particularly preferably from 500 to 10,000 in view of treatment efficiency for the surface treatment.

As methods for the surface treatment, there are two methods, a wet process and a dry process.

In the wet-process treatment, the conductive particles conductive metal oxide particles and the siloxane compound having structure represented by Formula (1) are dispersed in a solvent to make the siloxane compound adhere to the particle surfaces.

As a dispersion means, they may be dispersed by using a usual dispersion means such as a ball mill or a sand mill. Next, this dispersion is made to fix to the conductive-particle surfaces by heat treatment. In this heat treatment, Si—H bonds in siloxane undergo oxidation of hydrogen atoms which is caused by the oxygen in air in the course of the heat treatment to form additional siloxane linkages. As the result, the siloxane develops to come to have a three-dimensional network structure, and the conductive-particle surfaces are covered with this network structure. Thus, the surface treatment is completed upon making the siloxane compound fix to the conductive-particle surfaces. The particles having been thus treated may optionally be subjected to pulverization treatment.

In the dry-process treatment, the siloxane compound and the conductive metal oxide particles are mixed without use of any solvent, followed by kneading to make the siloxane compound adhere to the particle surfaces. Thereafter, like the case of the wet-process treatment, the resultant particles may be subjected to heat treatment and pulverization treatment to complete the surface treatment.

As the charge-transporting material usable in the protective layer of the electrophotographic photosensitive member according to the present invention, a compound having at least one hydroxyl group in the molecule is preferred. In particular, a compound having at least one hydroxyalkyl group, hydroxyalkoxyl group or hydroxyphenyl group in the molecule is preferred.

As a charge-transporting material having at least one of a hydroxyalkyl group and a hydroxyalkoxyl group in the molecule, a charge-transporting material having structure represented by any of the following Formulas (2) to (4) is preferred.

(2)

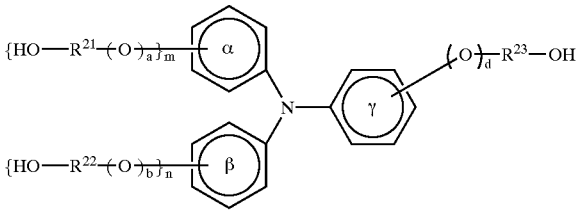

In Formula (2), $R^{21}$, $R^{22}$ and $R^{23}$ each independently represent a divalent hydrocarbon group having 1 to 8 carbon atoms and which may be branched. The benzene rings α, β and γ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. Letter symbols a, b, d, m and n each independently represent 0 or 1.

(3)

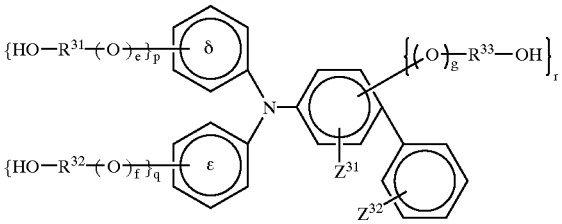

In Formula (3), $R^{31}$, $R^{32}$ and $R^{33}$ each independently represent a divalent hydrocarbon group having 1 to 8 carbon atoms and which may be branched. The benzene rings δ and ϵ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. Letter symbols e, f and g each independently represent 0 or 1. Letter symbols p, q and r each independently represent 0 or 1, provided that a case in which all of them are simultaneously 0 is excluded. $Z^{31}$ and $Z^{32}$ each independently represent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may combine to form a ring.

(4)

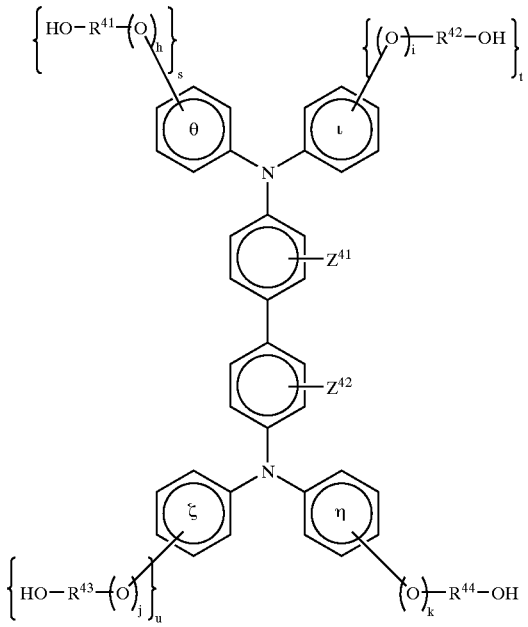

In Formula (4), $R^{41}$, $R^{42}$, $R^{43}$ and $R^{44}$ each independently represent a divalent hydrocarbon group having 1 to 8 carbon atoms and which may be branched. The benzene rings ζ, η, θ and ι may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. Letter symbols h, i, j, k, s, t and u each independently represent 0 or 1. $Z^{41}$ and $Z^{42}$ each independently represent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may combine to form a ring.

As a charge-transporting material having a hydroxyphenyl group in the molecule, a charge-transporting material having structure represented by any of the following Formulas (5) to (7) is preferred.

(5)

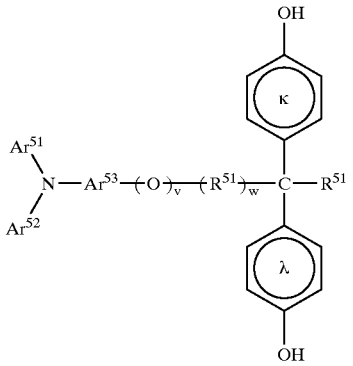

In Formula (5), $R^{51}$ represents a divalent hydrocarbon group having 1 to 8 carbon atoms and which may be branched. $R^{52}$ represents a hydrogen atom, a substituted or unsubstituted alkyl group, a substituted or unsubstituted aralkyl group or a substituted or unsubstituted phenyl group. $Ar^{51}$ and $Ar^{52}$ each independently represent a substituted or unsubstituted alkyl group, a substituted or unsubstituted aralkyl group, a substituted or unsubstituted aromatic hydrocarbon ring group or a substituted or unsubstituted aromatic heterocyclic group. $Ar^{53}$ represents a substituted or unsubstituted divalent aromatic hydrocarbon ring group or a substituted or unsubstituted divalent aromatic heterocyclic group. Letter symbols v and w each independently represent 0 or 1, provided that w is 0 when v is 0. The benzene rings κ and λ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group.

(6)

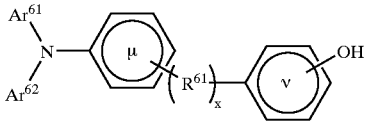

In Formula (6), $R^{61}$ represents a divalent hydrocarbon group having 1 to 8 carbon atoms and which may be branched. $Ar^{61}$ and $Ar^{62}$ each independently represent a substituted or unsubstituted alkyl group, a substituted or unsubstituted aralkyl group, a substituted or unsubstituted aromatic hydrocarbon ring group or a substituted or unsubstituted aromatic heterocyclic group. Letter symbol x represents 0 or 1. The benzene rings $\mu$ and ν may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or the benzene rings $\mu$ and ν may combine via a substituent to form a ring.

(7)

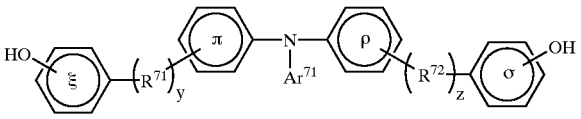

In Formula (7), $R^{71}$ and $R^{72}$ each independently represent a divalent hydrocarbon group having 1 to 8 carbon atoms and which may be branched. $Ar^{71}$ represents a substituted or unsubstituted alkyl group, a substituted or unsubstituted aralkyl group, a substituted or unsubstituted aromatic hydrocarbon ring group or a substituted or unsubstituted aromatic heterocyclic group. Letter symbols y and z each independently represent 0 or 1. The benzene rings ξ, π, ρ and σ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. The benzene rings ξ and π and the benzene rings ρ and σ may each independently combine via a substituent to form a ring.

In the above formulas (2) to (7), the divalent hydrocarbon groups represented by $R^{21}$, $R^{22}$, $R^{23}$, $R^{31}$, $R^{32}$, $R^{33}$, $R^{41}$, $R^{42}$, $R^{43}$, $R^{44}$, $R^{51}$, $R^{61}$, $R^{71}$ and $R^{72}$, having 1 to 8 carbon atoms and which may be branched, may include alkylene groups such as a methylene group, an ethylene group, a propylene group and a butylene group, an isopropylene group, and a cyclohexylidene group.

The alkyl group represented by $R^{52}$ may include a methyl group, an ethyl group, a propyl group and a butyl group; and the aralkyl group may include a benzyl group, a phenethyl group and a naphthylmethyl group.

Of the substituents the benzene rings α, β, γ, δ, ε, ζ, η, θ, ι, κ, λ, $\mu$, ν, ξ, π, ρ and σ may have, the halogen atom may include a fluorine atom, a chlorine atom, a bromine atom and an iodine atom; the alkyl group may include a methyl group, an ethyl group, a propyl group and a butyl group; the alkoxyl group may include a methoxyl group, an ethoxyl group, a propoxyl group and a butoxyl group; the aromatic hydrocarbon ring group may include a phenyl group, a naphthyl group, an anthryl group and a pyrenyl group; and the aromatic heterocyclic group may include a pyridyl group, a thienyl group, a furyl group and a quinolyl group.

In the cases in which the benzene rings $\mu$ and ν, the benzene rings ξ and π and the benzene rings ρ and σ each combine via a substituent to form a ring, the substituent may include a propylidene group and an ethylene group. Via such groups, cyclic structures such as a fluorene skeleton and a dihydrophenanthrene skeleton are formed.

The halogen atoms represented by $Z^{31}$, $Z^{32}$, $Z^{41}$ and $Z^{42}$ may also include a fluorine atom, a chlorine atom, a bromine atom and an iodine atom; the alkyl group may include a methyl group, an ethyl group, a propyl group and a butyl group; the alkoxyl group may include a methoxyl group, an ethoxyl group, a propoxyl group and a butoxyl group; the aromatic hydrocarbon ring group may include a phenyl group, a naphthyl group, an anthryl group and a pyrenyl group; and the aromatic heterocyclic group may include a pyridyl group, a thienyl group, a furyl group and a quinolyl group.

The alkyl groups represented by $Ar^{51}$, $Ar^{52}$, $Ar^{61}$, $Ar^{62}$ and $Ar^{71}$ may also include a methyl group, an ethyl group, a propyl group and a butyl group; the aralkyl group may include a benzyl group, a phenethyl group and a naphthylmethyl group; the aromatic hydrocarbon ring group may include a phenyl group, a naphthyl group, an anthryl group and a pyrenyl group; and the aromatic heterocyclic group may include a pyridyl group, a thienyl group, a furyl group and a quinolyl group.

The divalent aromatic hydrocarbon ring group represented by $Ar^{53}$ may include a phenylene group, a naphthylene group, an anthrylene group and a pyrenylene group; and the divalent aromatic heterocyclic group may include a pyridilene group and a thienylene group.

The substituents the above groups may have may include alkyl groups such as a methyl group, an ethyl group, a propyl group and a butyl group; aralkyl groups such as a benzyl group, a phenethyl group and a naphthylmethyl group; aromatic hydrocarbon ring groups and aromatic heterocyclic groups such as a phenyl group, a naphthyl group, an anthryl group, a pyrenyl group, a fluorenyl group, a carbazolyl group, a dibenzofuryl group and a benzothiophenyl; alkoxyl groups such as a methoxyl group, an ethoxyl group and a propoxyl group; aryloxyl groups such as a phenoxyl group and a naphthoxyl group; halogen atoms such as a fluorine atom, a chlorine atom, a bromine atom and an iodine atom; and a nitro group and a cyano group.

The charge-transporting material having structure represented by any of the above Formulas (2) to (7) has a good compatibility with the phenolic resin, and films of protective layers in which it has uniformly been dispersed can be produced with ease.

In order to more improve the compatibility, the divalent hydrocarbon groups represented by $R^{21}$, $R^{22}$, $R^{23}$, $R^{31}$, $R^{32}$, $R^{33}$, $R^{41}$, $R^{42}$, $R^{43}$ and $R^{44}$ in the above Formulas (2) to (4) may preferably be those having 4 or less carbon atoms, and also the number of the hydroxylalkyl group and hydroxylalkoxyl group may preferably be two or more.

In the charge-transporting material having structure represented by any of the above Formulas (5) to (7), the hydroxyphenyl group contained therein reacts with the phenolic resin, and the charge-transporting material is incorporated in the matrix of the protective layer, so that the layer can have a higher strength as the protective layer.

The charge-transporting material having structure represented by any of the above Formulas (2) to (7) is uniformly dissolved or dispersed in a coating fluid for producing the protective layer, and the coating fluid is coated to form the protective layer.

The charge-transporting material having structure represented by any of the above Formulas (2) to (7) and the binder resin may preferably be mixed in a proportion of charge-transporting material/binder resin=0.1/10 to 20/10, and particularly preferably 0.5/10 to 10/10. If the charge-transporting material is in a too small quantity in respect to the binder resin, the effect of lowering the residual potential may be small. If it is in a too large quantity, the protective layer may have a low strength.

Examples of the charge-transporting material having structure represented by any of the above Formulas (2) to (7) are shown below. Note that the present invention is by no means limited to these.

| No. | Exemplary Compounds |
|---|---|
| 1 | 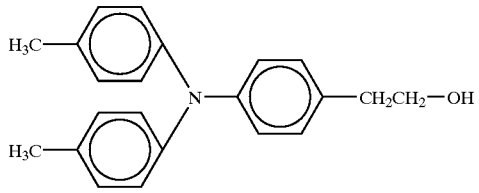 |
| 2 | 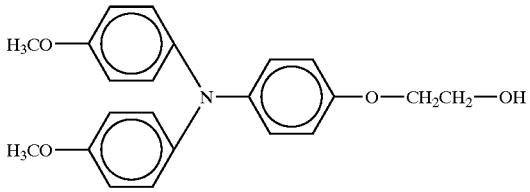 |
| 3 | 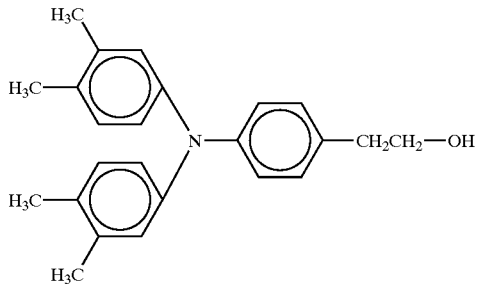 |
| 4 | 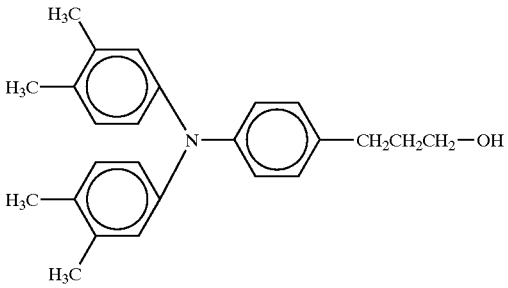 |

-continued
| No. | Exemplary Compounds |
|---|---|
| 5 | 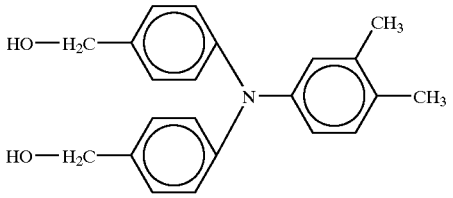 |
| 6 | 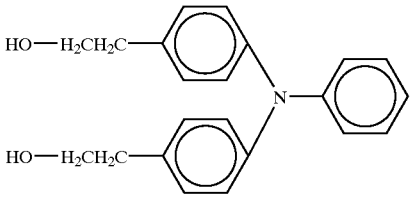 |
| 7 | 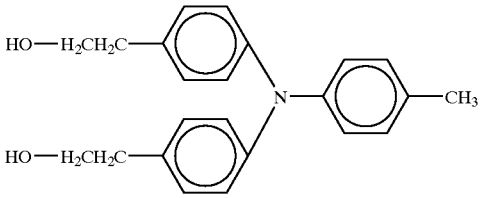 |
| 8 | 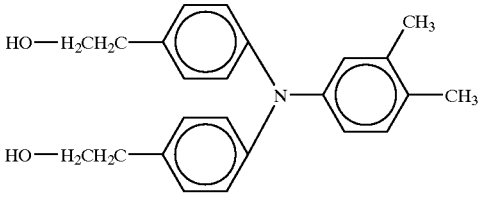 |
| 9 | 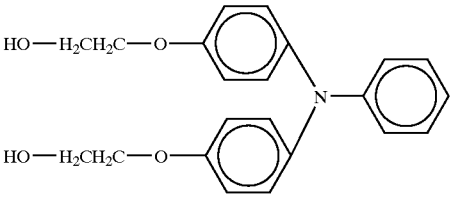 |
| 10 | 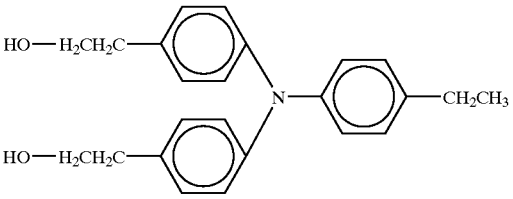 |
| 11 | 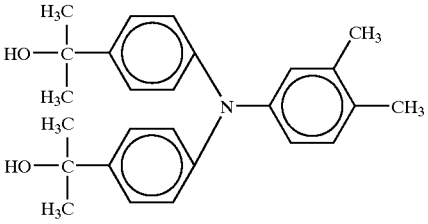 |

-continued
| No. | Exemplary Compounds |
|---|---|
| 12 | 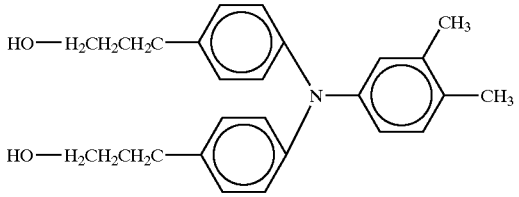 |
| 13 | 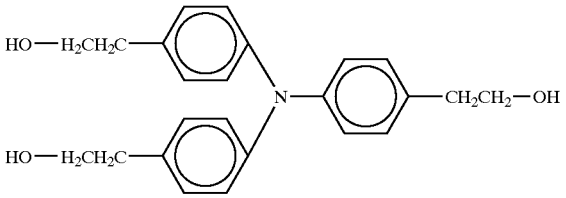 |
| 14 | 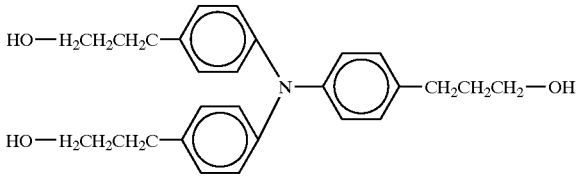 |
| 15 | 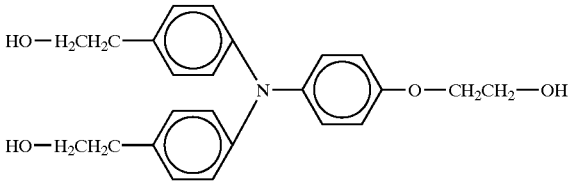 |
| 16 | 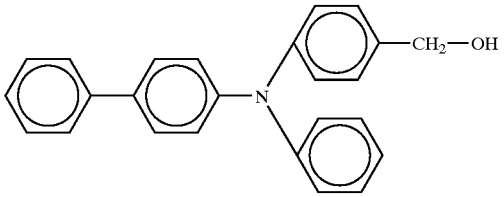 |
| 17 | 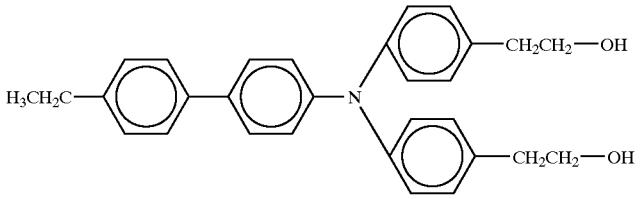 |
| 18 | 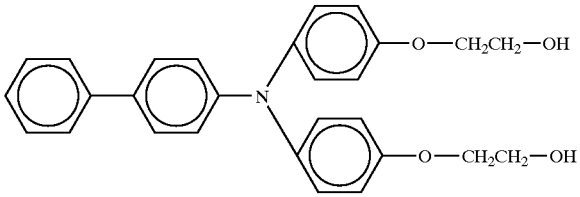 |

-continued
| No. | Exemplary Compounds |
|---|---|
| 19 | 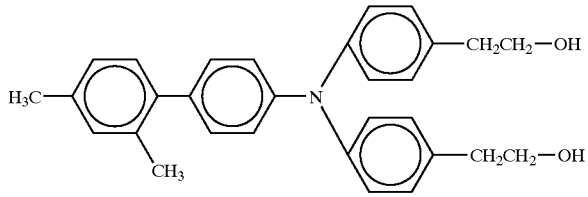 |
| 20 | 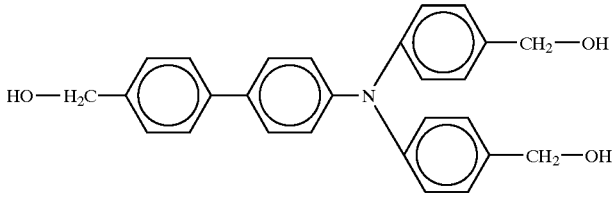 |
| 21 | 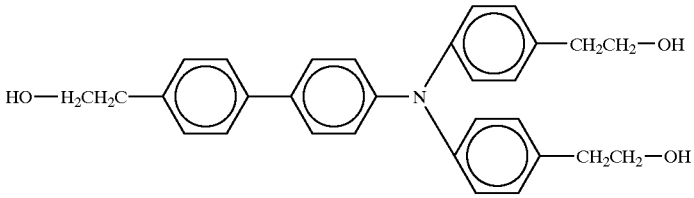 |
| 22 | 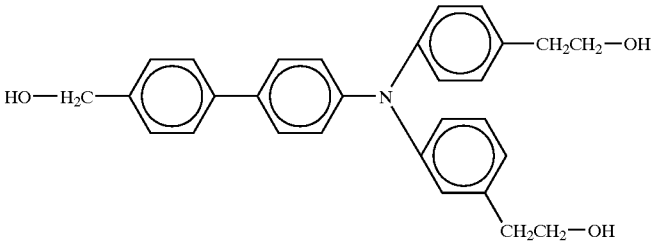 |
| 23 | 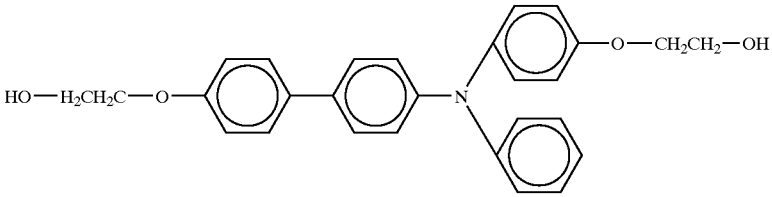 |
| 24 | 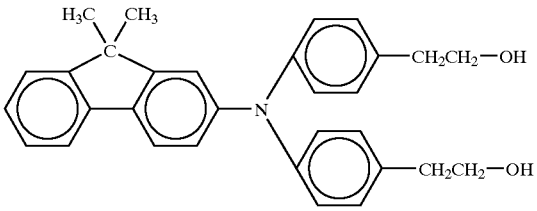 |
| 25 | 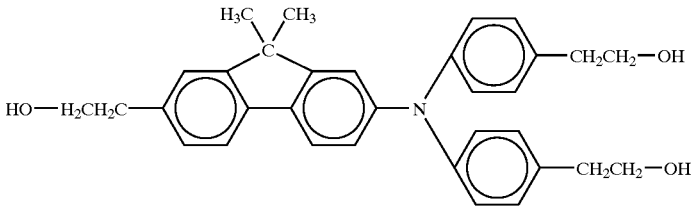 |

-continued
| No. | Exemplary Compounds |
|---|---|
| 26 | 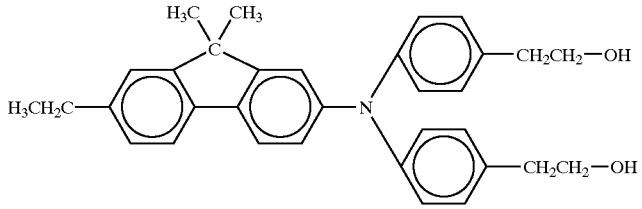 |
| 27 | 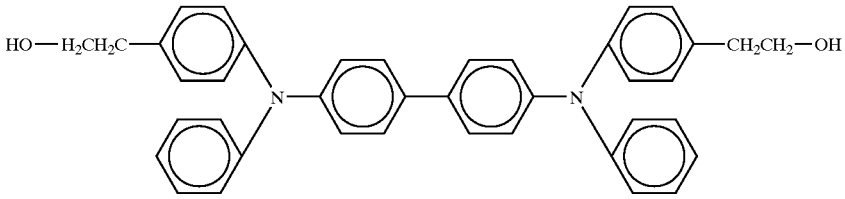 |
| 28 | 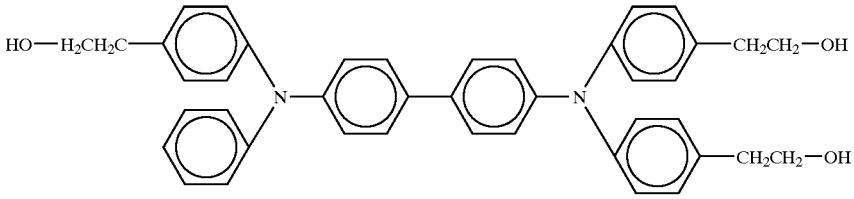 |
| 29 | 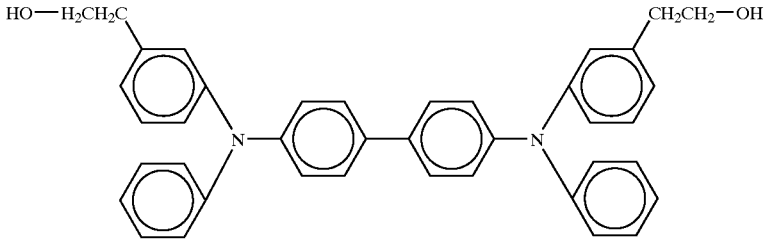 |
| 30 | 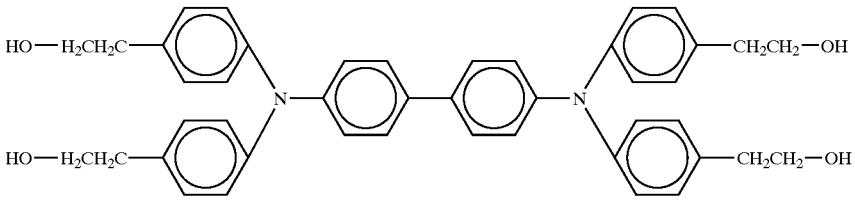 |
| 31 | 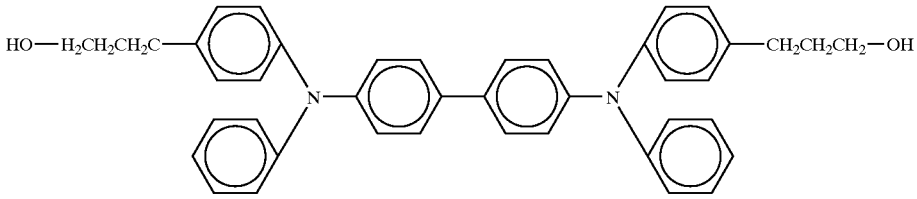 |
| 32 | 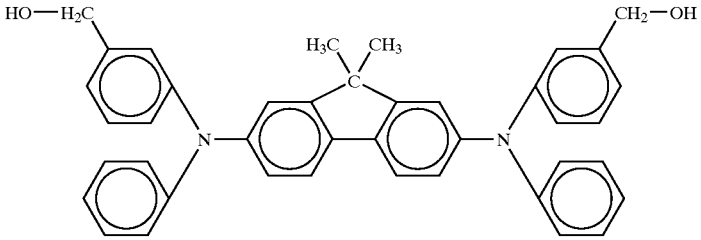 |

-continued
| No. | Exemplary Compounds |
|---|---|
| 33 | 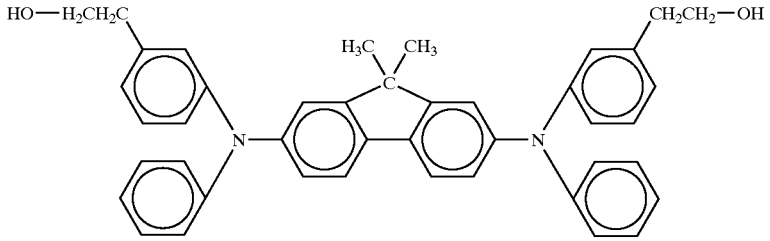 |
| 34 | 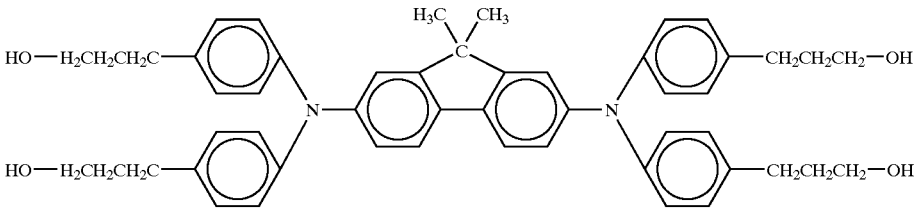 |
| 35 | 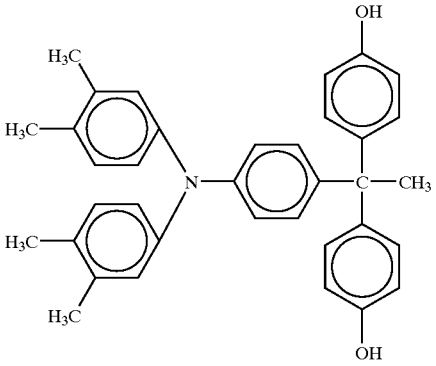 |
| 36 | 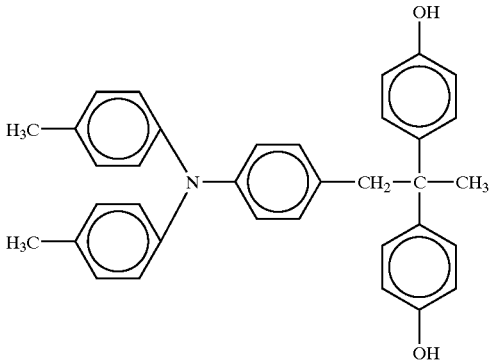 |

-continued
| No. | Exemplary Compounds |
|---|---|
| 37 | 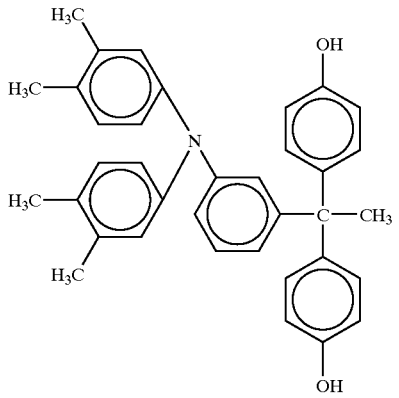 |
| 38 | 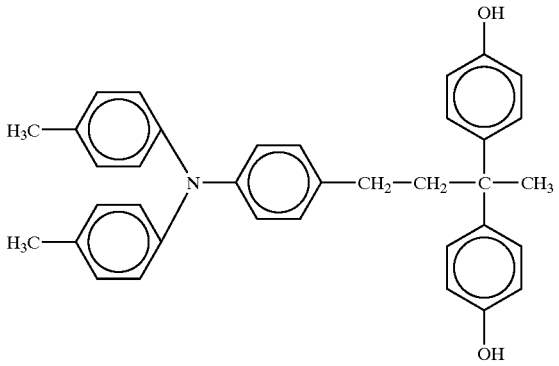 |
| 39 | 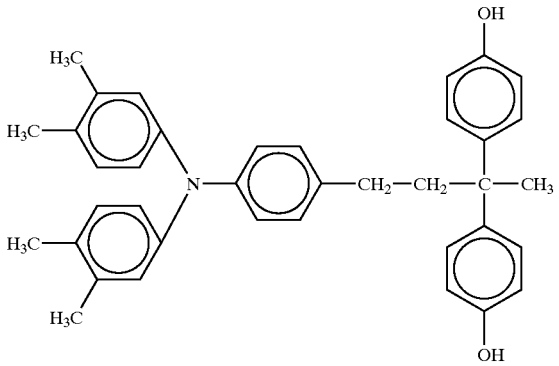 |
| 40 | 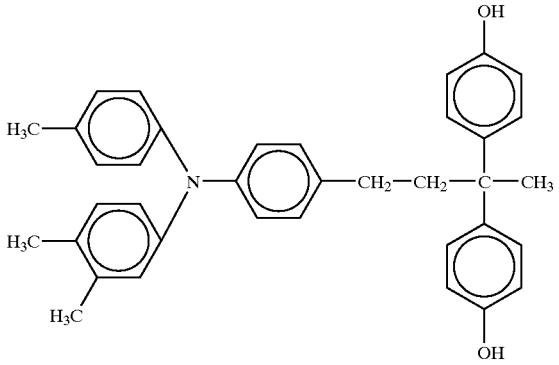 |

-continued
| No. | Exemplary Compounds |
|---|---|
| 41 | 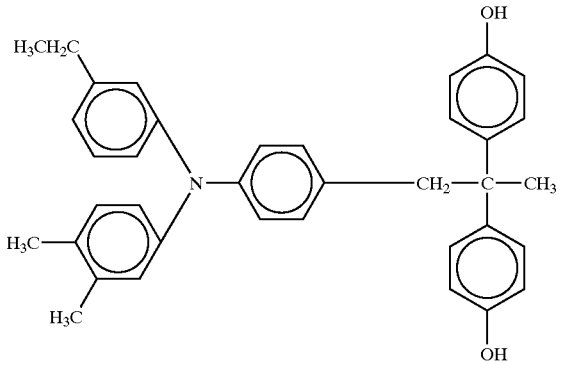 |
| 42 | 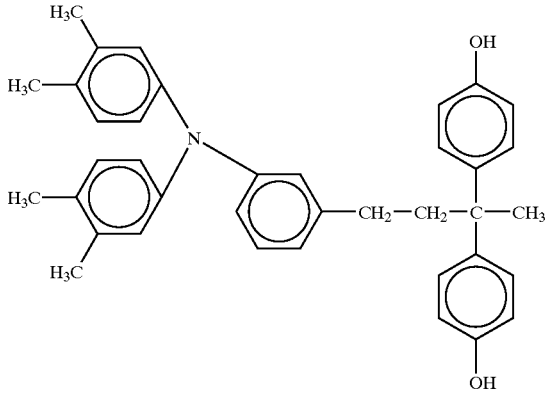 |
| 43 | 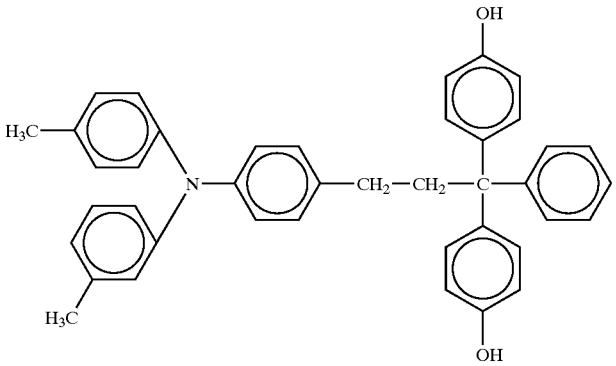 |
| 44 | 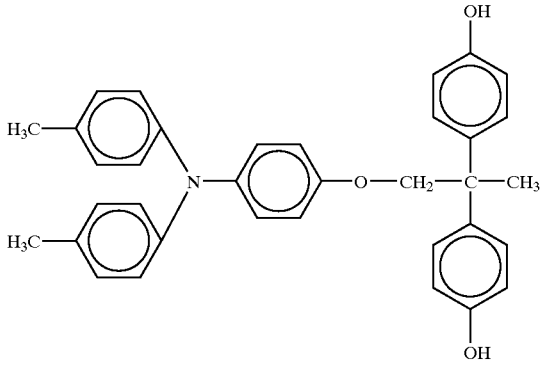 |

-continued
| No. | Exemplary Compounds |
|---|---|
| 45 | 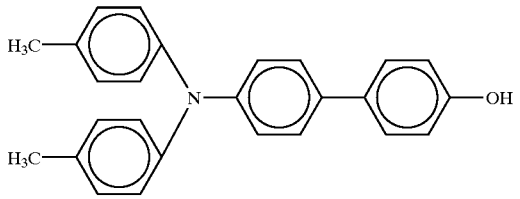 |
| 46 | 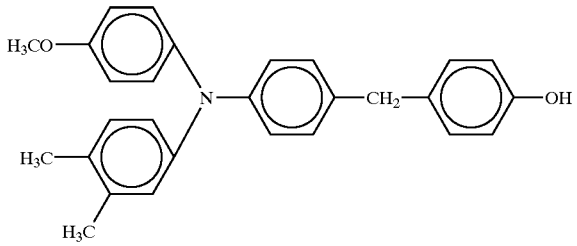 |
| 47 | 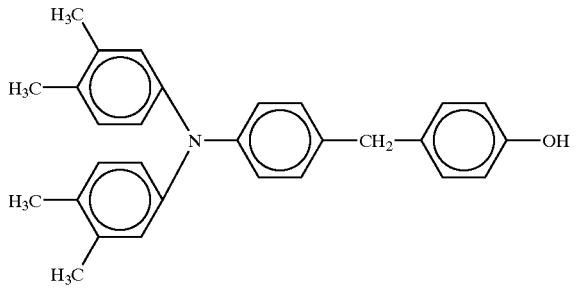 |
| 48 | 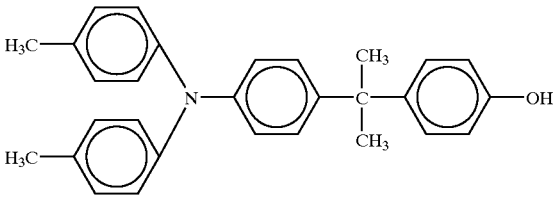 |
| 49 | 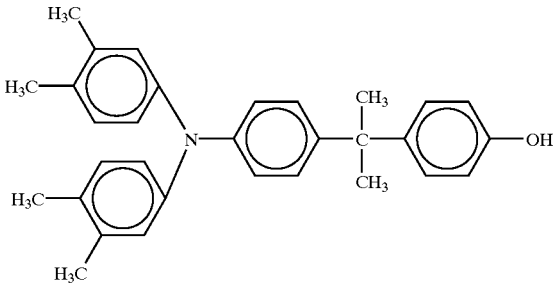 |
| 50 | 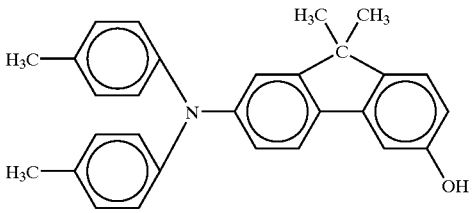 |

-continued
| No. | Exemplary Compounds |
|---|---|
| 51 | 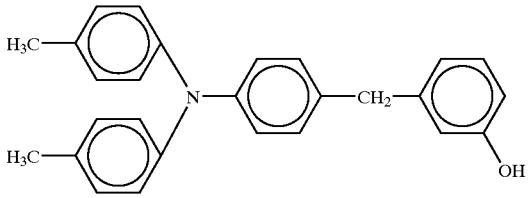 |
| 52 | 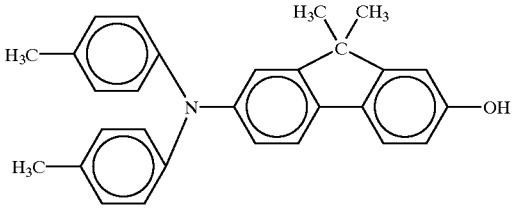 |
| 53 | 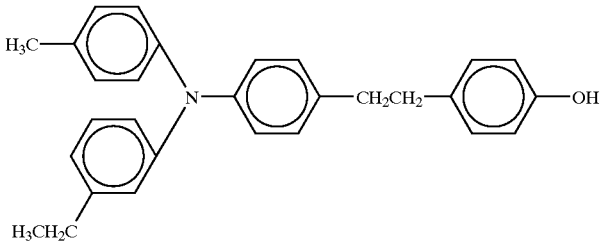 |
| 54 | 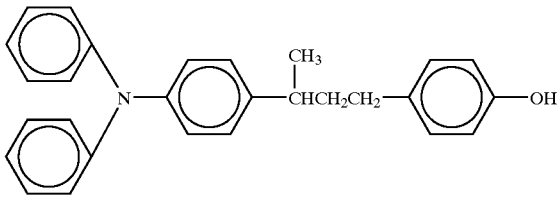 |
| 55 | 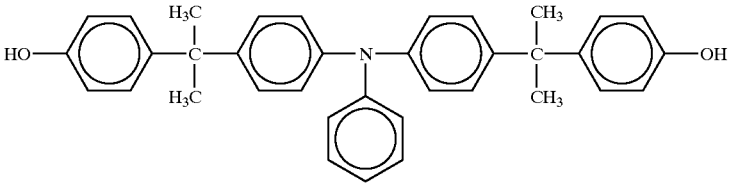 |
| 56 | 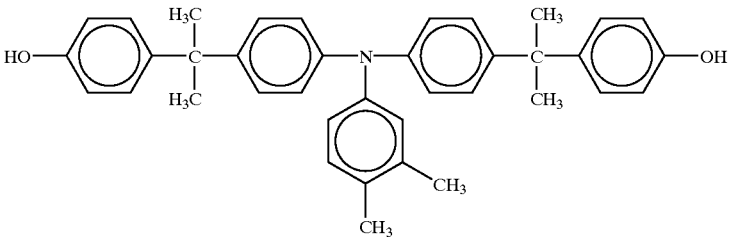 |
| 57 | 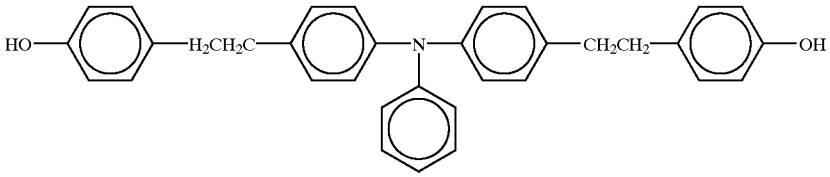 |

-continued

| No. | Exemplary Compounds |
|---|---|
| 58 | 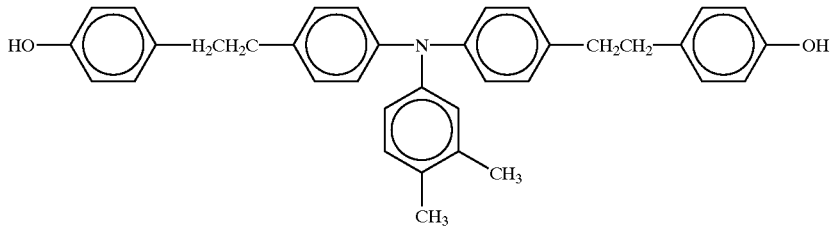 |
| 59 | 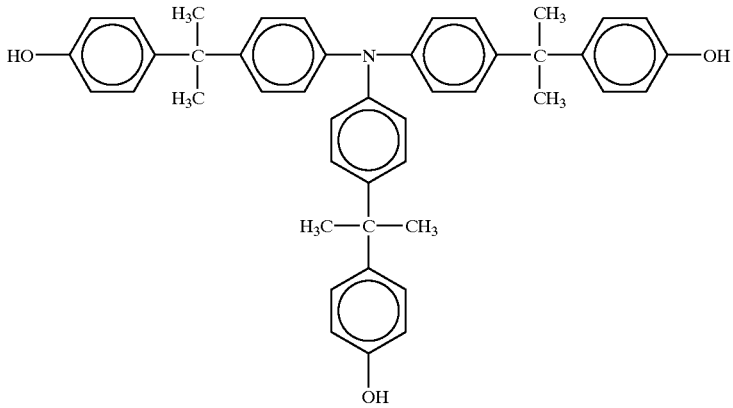 |
| 60 | 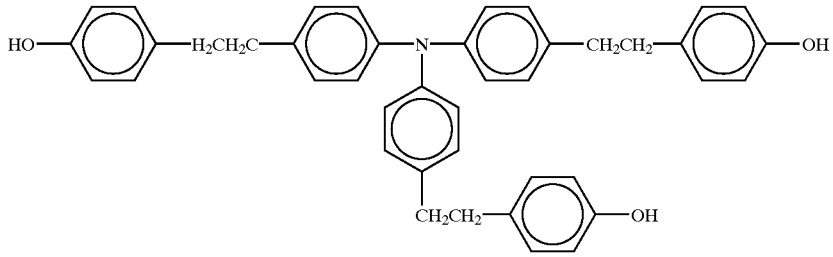 |

Of these, Exemplary Compounds (3), (4), (5), (8), (11), (12), (13), (17), (21), (24), (25), (26), (27), (28), (30), (31), (34), (35), (39), (44), (48), (49), (50), (52), (55), (56), (58) and (59) are preferred. Further, Exemplary Compounds (3), (8), (12), (25), (31), (39), (44), (49) and (56) are more preferred.

As the solvent in which the components for the protective layer coating fluid are to be dissolved or dispersed, a solvent is preferable which dissolves the binder resin sufficiently, sufficiently dissolves also the charge-transporting material having structure represented by any of the above Formulas (2) to (7), affords good dispersibility for the conductive particles where such particles are used, has good compatibility with and good treating performance for the lubricating particles such as the fluorine-atom-containing compound, the fluorine-atom-containing resin particles and the siloxane compound where such particles are used, and also does not adversely affect the charge transport layer with which the coating fluid for the protective layer is to come into contact.

Accordingly, usable as the solvent are alcohols such as methanol, ethanol and 2-propanol, ketones such as acetone and methyl ethyl ketone, esters such as methyl acetate and ethyl acetate, ethers such as tetrahydrofuran and dioxane, aromatic hydrocarbons such as toluene and xylene, and halogen type hydrocarbons such as chlorobenzene and dichloromethane, any of which may further be used in the form of a mixture. Of these, solvents most preferable for the form of the phenolic resin are alcohols such as methanol, ethanol and 2-propanol.

Conventional charge-transporting materials are commonly insoluble or slightly soluble in alcohol type solvents, and are uniformly dispersible with difficulty in common phenolic resins. However, many of the charge-transporting materials used in the present invention are soluble in solvents composed chiefly of alcohols, and hence can be dispersed in the solvent in which the phenolic resin is dissolved.

The protective layer of the electrophotographic photosensitive member according to the present invention may be formed by any coating method commonly used, such as dip coating, spray coating, spinner coating, roller coating, Meyer bar coating and blade coating. The present invention is especially effective when the protective layer is formed by dip coating, because the technical subject in the present invention tends to arise when formed by the dip coating.

In the present invention, additives such as an antioxidant may be incorporated in the protective layer in order to prevent the surface layer from deteriorating because of adhesion of active substances such as ozone and nitrogen oxides generated at the time of charging.

The photosensitive layer of the photosensitive member of the present invention has is described below.

Figure 2A:
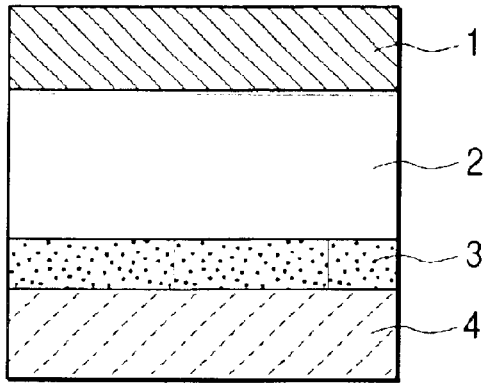
FIGS. 2A, 2B and 2C are sectional views showing examples of the layer construction of the electrophotographic photosensitive member according to the present invention.
Figure 2B:
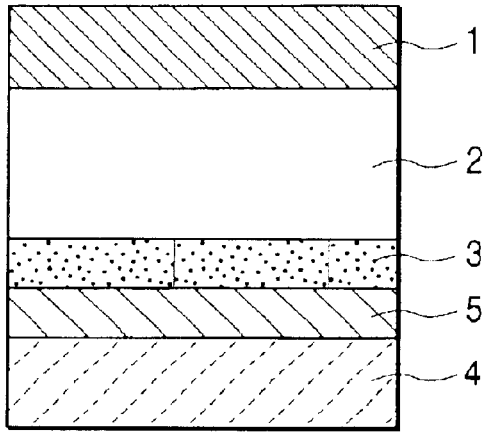
Figure 2C:
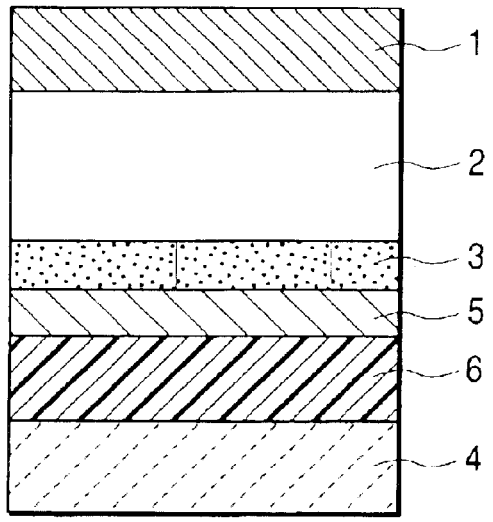

The photosensitive layer in the present invention has a multilayer structure. FIGS. 2A to 2C show examples thereof. The electrophotographic photosensitive member shown in FIG. 2A comprises a conductive support 4 and provided thereon a charge generation layer 3 and a charge transport layer 2 in this order, and a protective layer 1 further provided as the surface layer.

As the conductive support 4, it may be a support having conductivity for itself, as exemplified by supports made of a metal such as aluminum, aluminum alloy or stainless steel. Besides these, also usable are plastic supports on which aluminum, aluminum alloy, indium oxide-tin oxide alloy or the like has been formed in film by vacuum deposition, supports comprising plastic or paper impregnated with conductive particles (e.g., carbon black, tin oxide, titanium oxide or silver particles) together with a suitable binder resin, and plastics having a conductive binder.

As the shape of the conductive support 4, it may be, e.g., of a cylindrical-drum type or in the shape of a belt, and there are no particular limitations. As stated previously, the conductive support 4 has a tendency of being made shorter in length in their generatrix direction as electrophotographic apparatus are made small-sized. Where transfer paper such as A4-size or letter-size paper is used feeding the paper in the lengthwise direction, the developing region is in a width of about 215 mm. Where A4-size transfer paper is used feeding the paper in the lateral direction, the developing region is in a width of about 290 mm. In respect thereto, the conductive support has a length of about 10 to 80 mm plus the width of each of the developing regions. However, the technical subject in the present invention arises when the conductive support has a length within the range of from 10 to 50 mm plus the width of the developing region, and more remarkably arises when it has a length within the range of from 10 to 40 mm plus the width of the developing region.

In the present invention, a binding layer (adhesion layer) 5 having the function as a barrier and the function of adhesion may be provided between the conductive support 4 and the photosensitive layer (FIG. 2B).

The binding layer 5 is formed for the purposes of, e.g., improving the adhesion of the photosensitive layer, improving coating performance, protecting the support, covering any defects of the support, improving the injection of electric charges from the support and protecting the photosensitive layer from any electrical breakdown. The binding layer 5 may be formed of, e.g., casein, polyvinyl alcohol, ethyl cellulose, an ethylene-acrylic acid copolymer, polyamide, modified polyamide, polyurethane, gelatin or aluminum oxide. The binding layer 5 may preferably have a layer thickness of 5 $\mu$m or less, and more preferably from 0.1 $\mu$m to 3 $\mu$m.

In the present invention, as shown in FIG. 2C, the binding layer 5 and also a subbing layer 6 aiming at prevention of interference fringes may further be provided between the conductive support 4 and the charge generation layer 3.

The charge generation layer 3 contains a charge-generating material and optionally a binder resin.

The charge-generating material may include azo pigments such as monoazo, disazo and trisazo; phthalocyanine pigments such as metal phthalocyanines and metal-free phthalocyanine; indigo pigments such as indigo and thioindigo; perylene pigments such as perylene acid anhydrides and perylene acid imides; polycyclic quinone pigments such as anthraquinone and pyrenequinone; squarilium dyes; salts such as pyrylium salts and thiapyrylium salts; triphenylmethane dyes; inorganic materials such as selenium, selenium-tellurium and amorphous silicon; quinacridone pigments; azulenium salt pigments; cyanine dyes; xanthene dyes; quinoneimine dyes; styryl dyes; cadmium sulfide; and zinc oxide.

The binder resin may include polycarbonate resins, polyester resins, polyarylate resins, butyral resins, polystyrene resins, polyvinyl acetal resins, diallyl phthalate resins, acrylic resins, methacrylic resins, vinyl acetate resins, phenolic resins, silicone resins, polysulfone resins, styrene-butadiene copolymer resins, alkyd resins, epoxy resins, urea resins, and vinyl chloride-vinyl acetate copolymer resins. Examples are by no means limited to these. Any of these may be used alone or in the form of a mixture or copolymer of two or more types.

To form the charge generation layer 3, the charge-generating material may well be dispersed in the binder resin, which is used in a 0.3- to 4-fold quantity, together with a solvent by means of a homogenizer, an ultrasonic dispersion machine, a ball mill, a sand mill, an attritor or a roll mill, and the resultant dispersion is coated, followed by drying. It may preferably be formed in a layer thickness of 5 $\mu$m or less, and particularly from 0.01 $\mu$m to 1 $\mu$m.

As the solvent used therefor, it may be selected taking account of the solubility or dispersion stability of the charge-generating material or binder resin to be used. As an organic solvent, usable are alcohols, sulfoxides, ketones, ethers, esters, aliphatic halogenated hydrocarbons or aromatic compounds.

To the charge generation layer 3, a sensitizer, an antioxidant, an ultraviolet absorber, a plasticizer and so forth which may be of various types may also optionally be added.

The charge transport layer 2 contains a charge-transporting material and optionally a binder resin.

The charge-transporting material may include various triarylamine compounds, various hydrazone compounds, various styryl compounds, various stilbene compounds, various pyrazoline compounds, various oxazole compounds, various thiazole compounds, and various triarylmethane compounds.

The binder resin which may be used to form the charge transport layer may include acrylic resins, styrene resins, polyester resins, polycarbonate resins, polyarylate resins, polysulfone resins, polyphenylene oxide resins, epoxy resins, polyurethane resins, alkyd resins and unsaturated resins. Of these, polymethyl methacrylate, polystyrene, a styrene-acrylonitrile copolymer, polycarbonate resins and diallyl phthalate resins are particularly preferred.

The charge transport layer 2 may be formed by coating a solution prepared by dissolving the above charge-transporting material and binder resin in a solvent, followed by drying. The charge-transporting material and the binder resin may be mixed in a proportion of from about 2:1 to 1:2 in weight ratio.

As the solvent, it may include ketones such as acetone and methyl ethyl ketone, esters such as methyl acetate and ethyl acetate, aromatic hydrocarbons such as toluene and xylene, and chlorine type hydrocarbons such as chlorobenzene, chloroform and carbon tetrachloride.

When this charge transport layer coating solution is coated, coating methods as exemplified by dip coating, spray coating and spinner coating may be used. The present invention is effective especially in a coating method in which, like the dip coating, the conductive support 4 is vertically up and down moved in respect to the charge transport layer coating solution, because the technical subject in the present invention tends to arise when the layer is formed by such a method.

The drying may preferably be carried out at a temperature of from 10° C. to 200° C., and particularly preferably from 20° C. to 150° C., and for a time of from 5 minutes to 5 hours, and particularly preferably from 10 minutes to 2 hours.

To the charge transport layer 2, an antioxidant, an ultraviolet absorber, a plasticizer and so forth may further optionally be added.

In the present invention, the protective layer 1 is further formed on this charge transport layer 2 by the method described previously.

Specific embodiments of an electrophotographic apparatus making use of the electrophotographic photosensitive member of the present invention are shown below.

Embodiment 1

Figure 3:
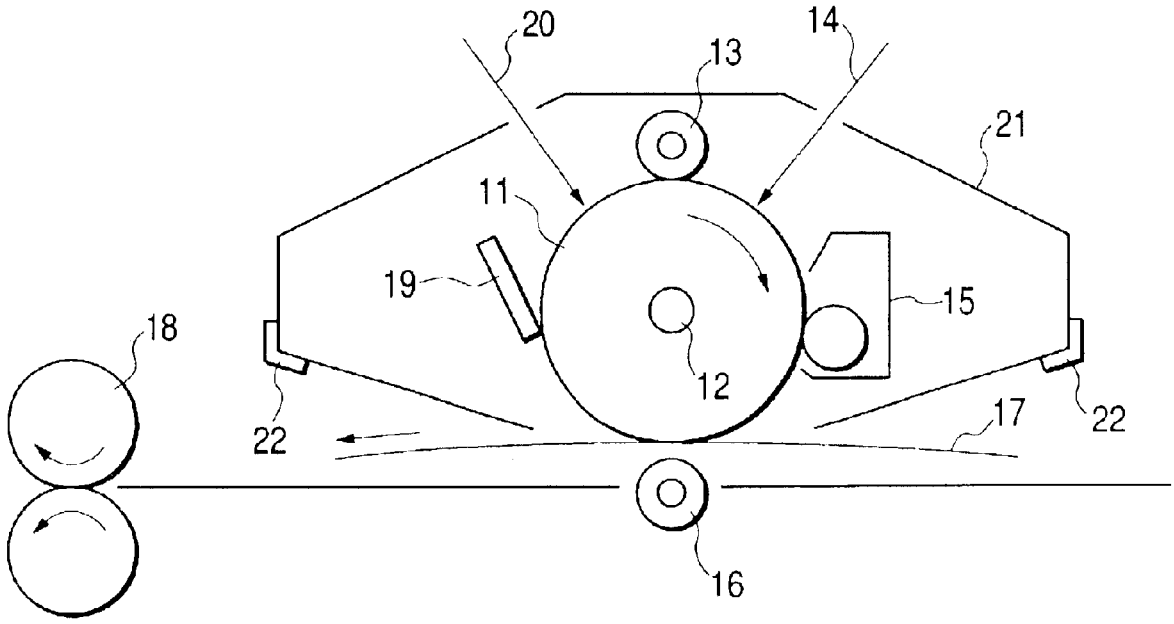
FIG. 3 is a schematic view showing the construction of Embodiment 1 which is an electrophotographic apparatus provided with a process cartridge having the electrophotographic photosensitive member according to the present invention.

FIG. 3 schematically illustrates the construction of an electrophotographic apparatus provided with a process cartridge having the electrophotographic photosensitive member of the present invention.

In FIG. 3, reference numeral 11 denotes a drum-shaped electrophotographic photosensitive member of the present invention, which is rotatingly driven around an axis 12 in the direction of an arrow at a stated peripheral speed.

The electrophotographic photosensitive member 11 is, in the course of its rotation, uniformly electrostatically charged on its periphery to a positive or negative, given potential through a (primary) charging means 13. The electrophotographic photosensitive member thus charged is then exposed to exposure light 14 emitted from an exposure means (not shown) for slit exposure or laser beam scanning exposure and intensity-modulated correspondingly to time-sequential digital image signals of the intended image information. In this way, electrostatic latent images corresponding to the intended image information are successively formed on the periphery of the electrophotographic photosensitive member 11.

The electrostatic latent images thus formed are subsequently developed with toner by the operation of a developing means 15. The toner images thus formed and held on the surface of the electrophotographic photosensitive member 11 are then successively transferred by the operation of a transfer means 16, to a transfer material 17 fed from a paper feed section (not shown) to the part between the electrophotographic photosensitive member 11 and the transfer means 16 in the manner synchronized with the rotation of the electrophotographic photosensitive member 11.

The transfer material 17 on which the toner images have been transferred is separated from the surface of the electrophotographic photosensitive member, is led through an image fixing means 18, where the toner images are fixed, and is then printed out of the apparatus as an image-formed material (a print or copy).

The surface of the electrophotographic photosensitive member 11 from which images have been transferred is brought to removal of the toner remaining after the transfer, through a cleaning means 19. Thus, its surface is cleaned. Such transfer residual toner may also directly be collected through the developing means without providing any cleaning means (cleanerless). The electrophotographic photosensitive member is further subjected to charge elimination by pre-exposure light 20 emitted from a pre-exposure means (not shown), and then repeatedly used for the formation of images. Where the primary charging means 13 is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 11, charging means 13, developing means 15 and cleaning means 19 so that the process cartridge is detachably mountable to the main body of an electrophotographic apparatus such as a copying machine or a laser beam printer. For example, at least one of the primary charging means 13, the developing means 15 and the cleaning means 19 may integrally be supported in a cartridge together with the electrophotographic photosensitive member 11 to form a process cartridge 21 that is detachably mountable to the main body of the apparatus through a guide means 22 such as rails provided in the main body of the apparatus.

In the case when the electrophotographic apparatus is a copying machine or a printer, the exposure light 14 is light reflected from, or transmitted through, an original, or light irradiated by the scanning of a laser beam, the driving of an LED array or the driving of a liquid-crystal shutter array according to signals obtained by reading an original through a sensor and converting the information into signals. Any other auxiliary process may also optionally be added.

Embodiment 2

Figure 4:
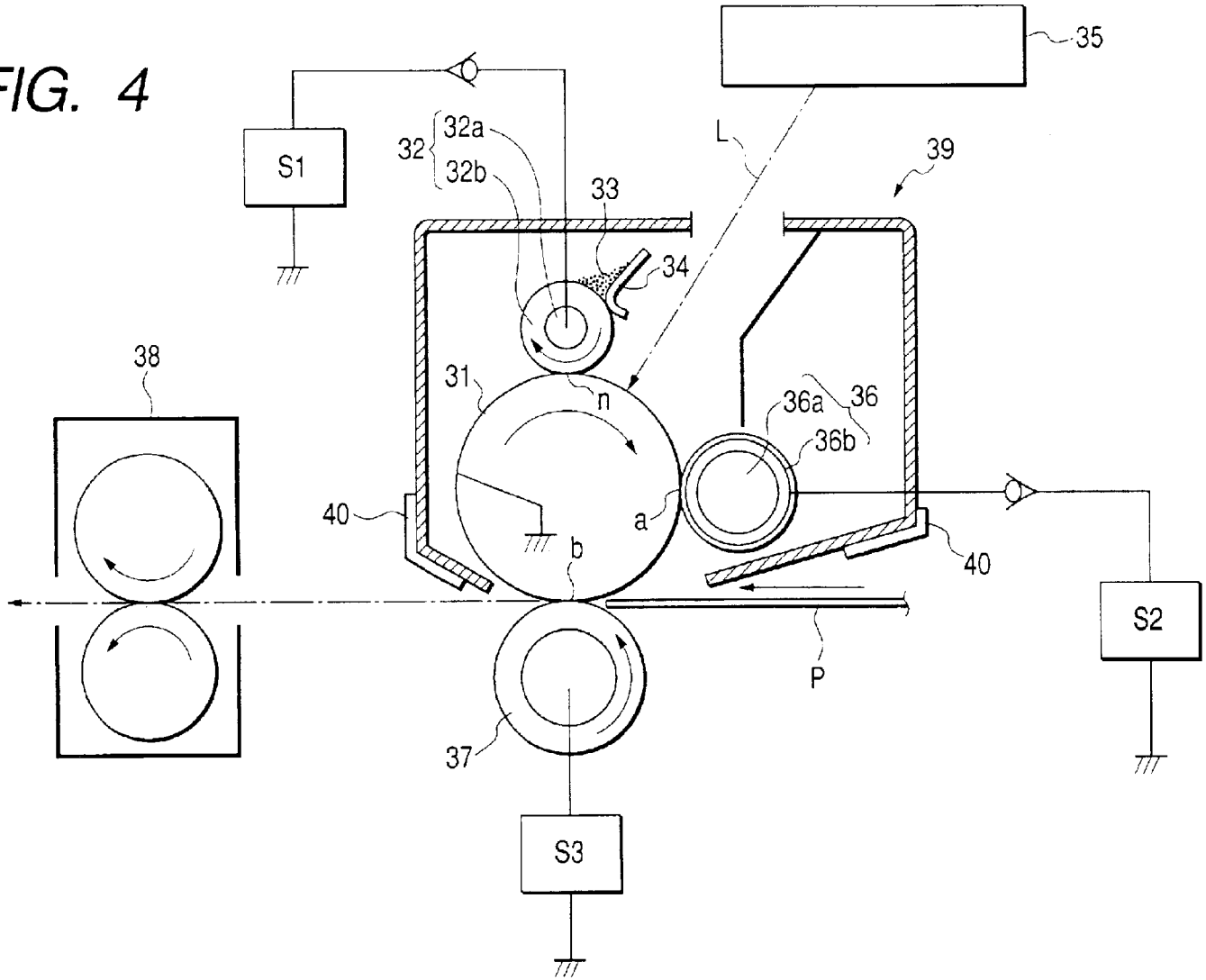
FIG. 4 is a schematic view showing the construction of Embodiment 2 which is another electrophotographic apparatus provided with a process cartridge having the electrophotographic photosensitive member according to the present invention.

FIG. 4 schematically illustrates the construction of an electrophotographic apparatus provided with a process cartridge having a means for feeding charging particles and having the electrophotographic photosensitive member of the present invention.

A drum-shaped electrophotographic photosensitive member 31 is rotatingly driven in the direction of an arrow at a constant peripheral speed.

A charging roller 32 a charging means has is constituted of charging particles 33 (conductive particles for charging the electrophotographic photosensitive member electrostatically), and a medium-resistance layer (elastic layer) 32*b* and a mandrel 32*a* which constitute a charging-particle-holding member. The charging roller 32 is in contact with the electrophotographic photosensitive member 31 in a preset elastic deformation level to form a contact zone n.

The charging roller 32 in this embodiment is constituted of the mandrel 32*a* and formed thereon the medium-resistance layer 32*b* comprised of a rubber or a foam, and further held on its surface the charging particles 33.

The medium-resistance layer 32*b* is comprised of a resin (e.g., urethane), conductive particles (e.g., carbon black), a vulcanizing agent and a blowing agent or the like, and is formed into a roller on the mandrel 32*a*. Thereafter, its surface is polished.

The charging roller in this embodiment differs from the charging roller (charging roller for discharging) in Embodiment 1 especially in the following points.

(1) Surface structure and roughness characteristics so designed as to hold the charging particles on its surface in a high density.
(2) Resistance characteristics (volume resistivity, surface resistance) necessary for injection charging.

The charging roller for discharging has a flat surface, and has a surface average roughness Ra of submicrons or less and also a high roller hardness. In the charging which utilizes discharging, a phenomenon of discharge takes place at spaces of tens of micrometers ($\mu$m) which are at a little distance from the contact zone between the charging roller and the electrophotographic photosensitive member. Where the charging roller and electrophotographic photosensitive member surfaces have any unevenness, the phenomenon of discharge may come unstable because of electric field intensities which differ at some part, to cause charge non-uniformity. Hence, the charging roller for discharging requires a flat and highly hard surface.

Now, the reason why the charging roller for discharging can not perform injection charging is that, although the charging roller having such surface structure as stated above externally appears to be in close contact with the drum (electrophotographic photosensitive member), the former is little in contact with the latter in the sense of microscopic contact performance on a molecular level which is necessary for charge injection.

On the other hand, the charging roller 32 for injection charging is required to have a certain roughness because it is necessary to hold thereon the charging particles 33 in a high density. It may preferably have an average surface roughness Ra of from 1 $\mu$m to 500 $\mu$m. If it has an Ra of less than 1 $\mu$m, it may have an insufficient surface area for holding thereon the charging particles 33, and also, where any insulator (e.g., the toner) has adhered to the roller surface layer, at its surroundings the charging roller 32 can come into contact with the electrophotographic photosensitive member 31 with difficulty, to tend to lower its charging performance. If on the other hand it has an Ra of more than 500 $\mu$m, the unevenness of the charging roller surface tends to lower the in-plane charge uniformity of the electrophotographic photosensitive member.

The average surface roughness Ra is measured with a surface profile analyzer microscope VF-7500 or VF-7510, manufactured by Keyence Co. Using objective lenses of 1,250 magnifications to 2,500 magnifications, the roller surface profile and Ra can be measured in non-contact.

The charging roller for discharging comprises a mandrel on which a low-resistance base layer is formed and thereafter its surface is covered with a high-resistance layer. In the roller charging effected by discharging, applied voltage is so high that, if there are any pinholes (at which the support stands uncovered because of the damage of the film), the drop of voltage may extend up to their surroundings to cause faulty charging. Accordingly, the charging roller may preferably be made to have a surface resistivity of $10^{11}$ Ω□ or more.

On the other hand, in the injection charging system, it is unnecessary to make the surface layer have a high resistance in order to make it possible to perform charging at a low voltage, and the charging roller may be constituted of a single layer. In the injection charging, the charging roller may rather preferably have a surface resistivity of from $10^4$ to $10^{10}$ Ω□. If it has a surface resistivity of more than $10^{10}$ Ω□, the in-plane charge uniformity may lower, and any non-uniformity due to the rubbing friction of the charging roller may appear as lines in halftone images, and a lowering of image quality level tends to be seen. If on the other hand it has a surface resistivity of less than $10^4$ Ω□, any pinholes of the electrophotographic photosensitive member tend to cause the drop of voltage at their surroundings even in the injection charging.

The charging roller may further preferably have a volume resistivity ranging from $10^4$ to $10^7$ Ω·cm. If it has a volume resistivity of less than $10^4$ Ω·cm, the drop of voltage tends to occur because of a leakage of electric current through pinholes. If on the other hand it has a volume resistivity of more than $10^7$ Ω·cm, any electric current necessary for the charging may be ensured with difficulty to tend to cause a lowering of charging voltage.

The resistivities of the charging roller are measured in the following way.

To measure roller resistivities, an insulator drum of 30 mm in outer diameter is provided with electrodes in such a way that a load of 1 kg in total pressure is applied to the mandrel 32*a* of the charging roller 32. As the electrodes, a guard electrode is disposed around a main electrode to make measurement. The distance between the main electrode and the guard electrode is adjusted substantially to the thickness of the elastic layer 32*b* so that the main electrode may ensure a sufficient width in respect to the guard electrode. To make measurement, a voltage of +100 V is applied from a power source to the main electrode, and electric currents flowing to ammeters Av and As are measured, and the volume resistivity and the surface resistivity, respectively, are measured.

In the injection charging system, it is important for the charging roller 32 to function as a soft electrode. In the case of a magnetic brush, it is materialized to do so in virtue of the flexibility a magnetic-particle layer itself has. In this embodiment, it is achieved by controlling the elastic properties of the medium-resistance layer (elastic layer) 32*b*. This layer may have an Asker-C hardness of from 15 degrees to 50 degrees as a preferable range, and from 25 degrees to 40 degrees as a more preferable range. If this layer has a too high hardness, any necessary elastic deformation level can not be attained, and the contact zone n can not be ensured between the charging roller and the electrophotographic photosensitive member, resulting in a lowering of charging performance. Also, the contact performance on a molecular level of substance can not be attained, and hence any inclusion of foreign matter may obstruct the contact at its surroundings. If on the other hand this layer has a too low hardness, the roller may have unstable shape to provide a non-uniform pressure of contact with the charging object (electrophotographic photosensitive member) to cause charge non-uniformity. Otherwise, such a layer may cause faulty charging due to compression set of the roller as a result of its long-term leaving.

Materials for the charging roller 32 may include ethylene-propylene-diene-methylene rubber (EPDM), urethane rubber, nitrile-butadiene rubber (NBR) and silicone rubber, and rubber materials such as isoprene rubber (IR) in which a conductive substance such as carbon black or a metal oxide has been dispersed for the purpose of resistance control. Without dispersing any conductive substance, it is also possible to make resistance control by using an ion-conductive material. Thereafter, if necessary, the surface roughness may be adjusted, or shaping may be made by polishing or the like. Also, a plurality of functionally separated layers may make up the elastic layer.

As a form of the roller, a porous-member structure is preferable. This is advantageous in view of manufacture in that the above surface roughness is achievable at the same time the roller is formed by molding. It is suitable for the porous member to have a cell diameter of from 1 $\mu$m to 500 $\mu$m. After the porous member has been formed by foam molding, its surface may be abraded to make the porous surface exposed, to produce a surface structure having the above roughness.

The charging roller 32 is provided in a stated elastic deformation level in respect to the electrophotographic photosensitive member 31 to form the contact zone n. At this contact zone n, the charging roller, which is rotatingly driven in the direction opposite (counter) to the rotational direction of the electrophotographic photosensitive member 31, can come into contact with the electrophotographic photosensitive member 31 in the state the former has a velocity difference in respect to the latter's surface movement. Also, at the time of image recording of a printer, a stated charging bias is applied to the charging roller 32 from a charging bias application power source S1. Thus, the periphery of the electrophotographic photosensitive member 31 is uniformly electrostatically charged to stated polarity and potential by the injection charging system.

The charging particles 33 are added to the toner and held in a developing assembly, and they are fed to the charging roller 32 via the electrophotographic photosensitive member 31 at the same time the toner participates in development. As a feeding means therefor, construction is employed in which a control blade 34 is brought into contact with the charging roller 32 and the charging particles 33 are held between the charging roller 32 and the control blade 34. Then, the charging particles 33 are coated in a constant quantity on the charging roller 32 as the electrophotographic photosensitive member 31 is rotated, and reach the contact zone n between the charging roller 32 and the electrophotographic photosensitive member 31.

The charging particles 33 may also preferably have a particle diameter of 10 $\mu$m or less in order to ensure high charging efficiency and charging uniformity. In the present invention, the particle diameter in a case in which the charging particles constitute agglomerates is defined as average particle diameter of the agglomerates, as such. To measure the particle diameter, at least 100 particles are picked up through observation on an electron microscope, where their volume particle size distribution is calculated on the basis of horizontal-direction maximum chordal length, and the particle diameter is determined on the basis of its 50% average particle diameter.

The charging particles 33 not only may be present in the state of primary particles, but also may be present in the state of agglomerated secondary particles without any problem at all. In whatever state of agglomeration, their form is not important as long as the agglomerates, as such, can function as the charging particles.

The charging particles 33 may preferably be white or closely transparent so that they do not especially obstruct latent-image exposure when used in the charging of the electrophotographic photosensitive member. They may further preferably be colorless or white when used in color image recording, taking account of the fact that the charging particles may partly inevitably be transferred to the transfer material P from the surface of the electrophotographic photosensitive member 31. Also, in order to prevent light scattering from being caused by the charging particles 33 at the time of imagewise exposure, they may preferably have a particle diameter which is not larger than the size of component image pixels, and more preferably not larger than the particle diameter of the toner. As the lower limit of the particle diameter, 10 nm is considered to be the limit as a size in which they are stably obtainable as particles.

Reference numeral 36 denotes a developing assembly. Electrostatic latent images formed on the surface of the electrophotographic photosensitive member 31 are developed as toner images by means of this developing assembly 36 at a developing zone a. In the developing assembly 36, a blended agent of a toner and charging particles added thereto is provided.

The electrophotographic apparatus (printer) in this embodiment carries out a toner recycle process. The transfer residual toner having remained on the surface of the electrophotographic photosensitive member 31 after transfer of toner images is not removed by a cleaning means (cleaner) used exclusively therefor, but is temporarily collected on the charging roller 32 which is counter-rotated as the electrophotographic photosensitive member 31 is rotated. Then, as it moves circularly on the periphery of the charging roller 32, the toner whose electric charges having been reversed are normalized is successively thrown out to the electrophotographic photosensitive member 31 and reaches the developing zone a, where it is collected at a developing means 36 including a magnet roller 36*a* and a developing sleeve 36*b* by cleaning-at-development and is reused there.

Reference numeral 35 denotes a laser beam scanner (exposure means) having a laser diode polygon mirror and so forth. This laser beam scanner 35 emits laser light intensity-modulated correspondingly to time-sequential digital image signals of the intended image information, and subjects the uniformly charged surface of the electrophotographic photosensitive member to scanning exposure L through the laser light. As a result of this scanning exposure L, electrostatic latent images corresponding to the intended image information are formed on the surface of the electrophotographic photosensitive member 31. The electrostatic latent images thus formed are developed by the developing means 36 to form toner images. To the developing means 36, a developing bias is applied from a power source S2.

Reference numeral 38 denotes a fixing means of, e.g., a heat fixing system. A transfer material P which has been fed to a transfer contact zone b between the electrophotographic photosensitive member 31 and a transfer roller 37 and to which the toner images have been transferred thereat under application of transfer bias from a power source S3 is separated from the surface of the electrophotographic photosensitive member 31. It is then guided into this fixing means 38, where the toner images are fixed, and then put out of the apparatus as an image-formed matter (a print or a copy).

Reference numeral 39 denotes a process cartridge which, in this embodiment, is constituted of the electrophotographic photosensitive member 31, the charging roller 32 and the developing assembly 36 which are integrally supported in the cartridge, and is detachably mountable to the main body of the apparatus through a guide means such as rails 40 provided in the main body of the apparatus.

The electrophotographic photosensitive member of the present invention may be not only applied in electrophotographic copying machines, but also widely applied in the fields where electrophotography is applied, e.g., laser beam printers, CRT printers, LED printers, facsimile machines, liquid-crystal printers, and laser platemaking.

Examples of the present invention are given below. The present invention is by no means limited to the following Examples. In the following Examples and Comparative Examples, "part(s)" refers to "part(s) by weight".

EXAMPLE 1

On an aluminum cylinder as a conductive support, having an outer diameter of 30 mm and a length of 261 mm, a 5% by weight methanol solution of a polyamide resin (trade name: AMILAN CM8000; available from Toray Industries, Inc.) was coated by dip coating, followed by drying to form a binding layer with a layer thickness of 0.5 $\mu$m.

Next, 2 parts of hydroxygallium phthalocyanine crystals having strong peaks at Bragg's angles ($2\theta \pm 0.2°$) of 7.4° and 28.2° in the CuK$\alpha$ characteristic X-ray diffraction and 1 part of polyvinyl butyral resin (trade name: S-LEC BX-1; available from Sekisui Chemical Co., Ltd.) were added to 120 parts of cyclohexanone, and these were dispersed for 3 hours by means of a sand mill making use of glass beads of 1 mm in diameter, followed by further addition of 120 parts of ethyl acetate to make dilution to prepare a charge generation layer coating dispersion. This coating dispersion was dip-coated on the above binding layer, followed by drying at 100° C. for 10 minutes to form a charge generation layer with a layer thickness of 0.15 $\mu$m.

Figure 5:
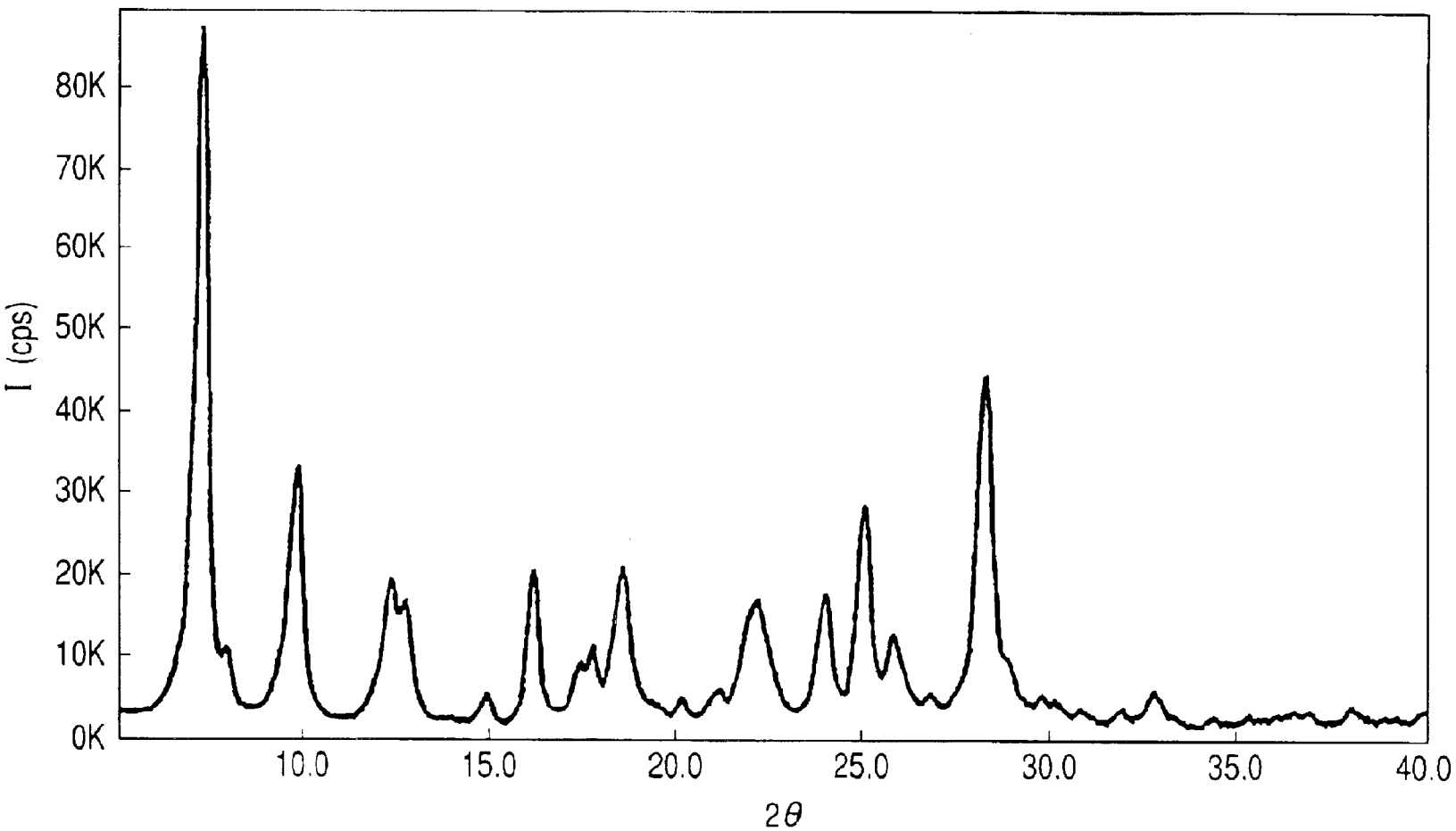
FIG. 5 is a chart of CuKα characteristic X-ray characteristic of hydroxygallium phthalocyanine used in Examples of the present invention.

A powder X-ray diffraction pattern of the hydroxygallium phthalocyanine crystals is shown in FIG. 5. The powder X-ray diffraction was measured using CuKα radiations and under the following conditions.

Measuring instrument used: Full-automatic X-ray diffractometer MXP18, manufactured by Mach Science Co.
X-ray tube: Cu
Tube voltage: 50 kV
Tube current: 300 mA
Scanning method: 2θ/θ scan
Scanning speed: 2 deg./min.
Sampling interval: 0.020 deg.
Start angle (2θ): 5 deg.
Stop angle (2θ): 40 deg.
Divergent slit: 0.5 deg.
Scattering slit: 0.5 deg.
Receiving slit: 0.3 deg.
Concave monochromator was used.

Next, as a charge-transporting material 10 parts of a compound having structure represented by the following formula:

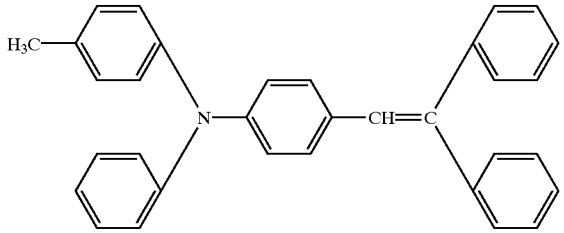

and as a binder resin 10 parts of bisphenol-Z polycarbonate (trade name: IUPILON Z-200; available from Mitsubishi Gas Chemical Company, Inc.) were dissolved in a mixed solvent of 60 parts of monochlorobenzene and 60 parts of tetrahydrofuran (THF) to prepare a charge transport layer coating solution.

This solution had a viscosity of 170 mPa·s. This charge transport layer coating solution was dip-coated on the above charge generation layer, followed by drying at 105° C. for 1 hour to form a charge transport layer. The dip coating was carried out by making the cylinder begin to be immersed from its lower end, immersing it up to a position of 2 mm from its upper end, and then lifting it up from that position at a speed of 180 mm/minute.

To make a standard of layer thickness control for the protective layer, the layer thickness of the charge transport layer formed was measured at positions of 12 mm from the upper end of the cylinder (i.e., 10 mm from the charge transport layer coating upper end) and the middle portion 130.5 mm, which was measured with the instantaneous multiple photometric system MCPD-2000 (trade name; manufactured by Ohtsuka Denshi K.K.). The layer thickness was measured at four spots in the peripheral direction at the respective positions, and their average values were found to find that they were 17.2 μm and 20.2 μm, respectively.

Next, 20 parts of antimony-doped ultrafine tin oxide particles surface-treated with a compound (amount of treatment: 7%) having structure represented by the following formula:

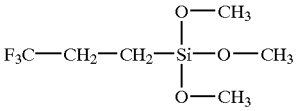

30 parts of antimony-doped fine tin oxide particles surface-treated with methylhydrogen silicone oil (trade name: KF99; available from Shin-Etsu Silicone Co., Ltd.) (amount of treatment: 20%) and 170 parts of ethanol were dispersed by means of a sand mill over a period of 66 hours, and 20 parts of fine polytetrafluoroethylene particles (average particle diameter: 0.18 μm) were further added, followed by dispersion for 2 hours. Thereafter, in the resultant dispersion, 30 parts of resol type heat-curable phenolic resin (trade name: PL-4804; containing an amine compound; available from Gun-ei Chemical Industry Co., Ltd.) was dissolved as a resin component to prepare a liquid preparation 1. Taking account of a difference in layer thickness from that of the above charge transport layer, the liquid preparation 1 was so diluted with ethanol as to have a solid content of 23.4%, to make up a liquid preparation 2.

Figure 6:
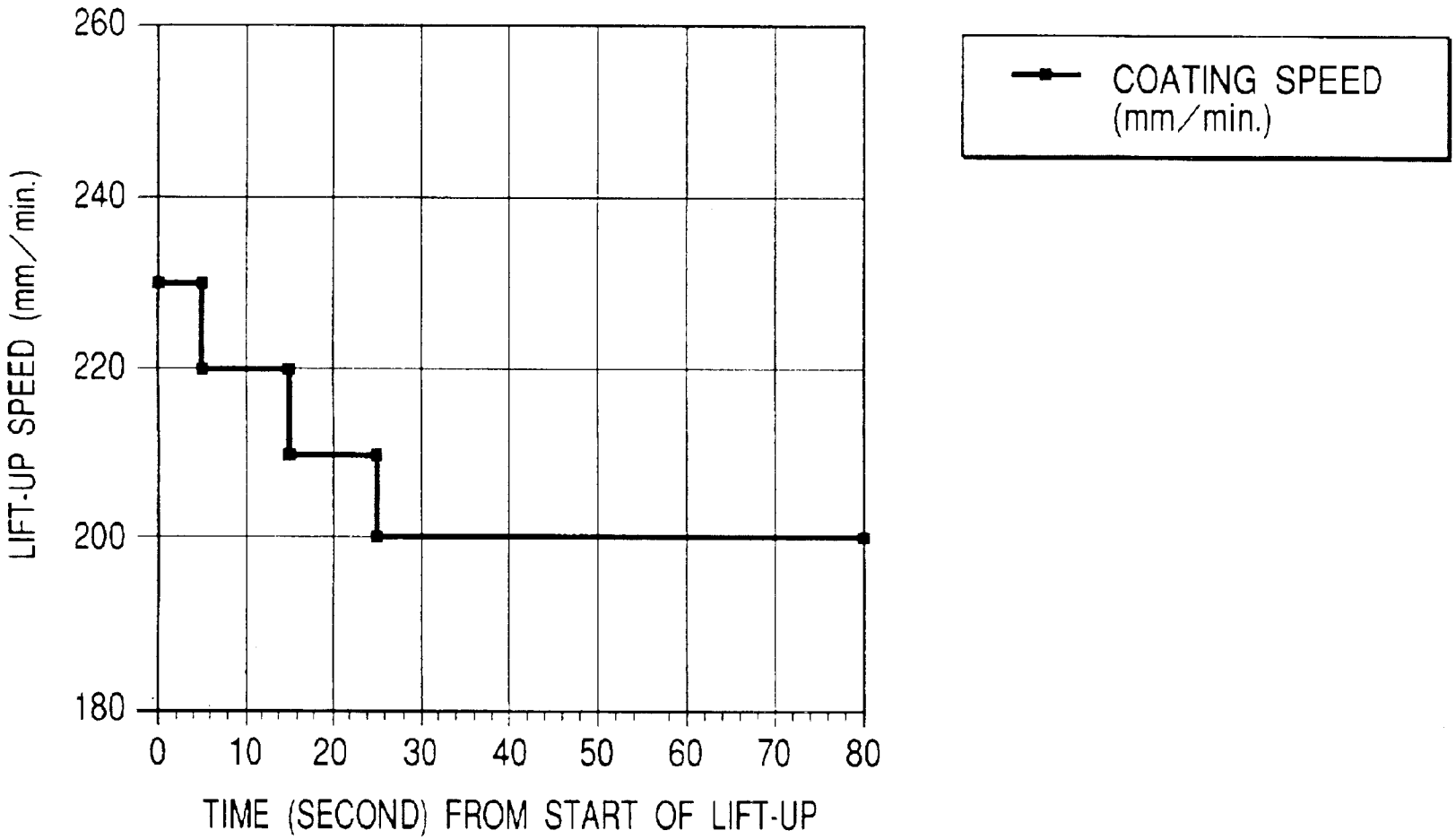
FIG. 6 is a graph showing changes in lift-up speed of a cylindrical support in respect to the lapse of time in a case in which a protective layer is formed by coating.

This liquid preparation 2 was dip-coated on the charge transport layer, followed by drying at 145° C. for 1 hour to form a protective layer. The dip coating was carried out by making the cylinder begin to be immersed from its lower end, immersing it up to a position of 3 mm from its upper end, and then lifting it up from that position. The cylinder was lifted up at a speed of 230 mm/minute until 5 minutes from the start of lift-up, 220 mm/minute for the following 10 seconds, 210 mm/minute for the following 10 seconds, and thereafter 200 mm/minute kept constant until the coating was completed. A graph showing the lift-up speed of the cylinder in respect to the lapse of time is shown in FIG. 6.

On the electrophotographic photosensitive member thus obtained, positions were marked in respect of layer thickness at positions of 12 mm, 22 mm, 42 mm, 62 mm and 102 mm from the upper end of the cylinder (i.e., 10 mm, 20 mm, 40 mm, 60 mm and 100 mm from the charge transport layer coating upper end) and the middle portion 130.5 mm (four spots for the middle portion only). The photosensitive member was cut in about 5 mm square in the shape embracing each spot. Samples obtained were etched by means of FIB (manufactured by Hitachi Ltd.) from the surface protective layer and up to the photosensitive layer and the binding layer. Then, sections of the samples were observed at an angle of 45°, and correction was made for the angle. Thus, the layer thickness of the protective layer and that of the charge transport layer were measured. In respect of the middle portion only, these were measured at four spots, and their average values were regarded as the layer thickness.

As the result, the layer thickness of the charge transport layer was found to be 17.2 μm, 18.3 μm, 18.9 μm, 19.4 μm, 19.8 μm and 20.2 μm (the middle portion) in the order near to the end portion. Similarly, the layer thickness of the protective layer was found to be 1.84 μm, 1.96 μm, 2.03 μm, 2.10 μm, 2.14 μm and 2.20 μm (the middle portion). In this Example, the layer thickness was measured at these typical five spots only. Taking account of a production process, even only the measurement at five spots is enough for the judgment of whether or not the $a_0$, a, $b_0$ and b satisfy the expressions (1) and (2).

Meanwhile, the electrophotographic photosensitive member obtained as described above was fitted to a remodeled machine of an electrophotographic apparatus (trade name: LASER JET 4000; manufactured by Hewllet-Pachard Co.) having the same electrophotographic system as that of the above Embodiment 1, and images were reproduced to make their evaluation. What was chiefly remodeled was that the formation of images was so made as to begin at the position of 12 mm from the upper end of the cylinder. The amount of laser light was so set that light-area potential VI (V) came to −150 V at the middle portion in the generatrix direction of the conductive support, and halftone images of 1,200 dpi formed at the initial stage and after 5,000-sheet running were visually observed. In case of running test, character image with 6% printing rate was used and in case of evaluation test, one-dot-one-space halftone image in which enclosing 1200 dpi one-dot black with one-dot whites is continued was used. The results are shown in Table 1.

EXAMPLE 2

An electrophotographic photosensitive member was evaluated in the same manner as in Example 1 except that the electrophotographic apparatus was remodeled in the manner as shown in Embodiment 2.

The charging roller was produced by forming a rubber medium-resistance layer on a mandrel. The medium-resistance layer was formed using urethane resin, conductive particles (carbon black), a vulcanizing agent and a blowing agent and shaped into a roller on the mandrel, and thereafter its surface was polished to produce a roller of 12 mm in diameter and 230 mm in length. The electrical resistance of this roller was measured to find that it was 100 kΩ. It was measured applying a DC voltage of 100 V to the mandrel of the charging roller and the support of the electrophotographic photosensitive member in the state the charging roller was kept in pressure contact with the electrophotographic photosensitive member in such a way that a load of 1 kg in total pressure was applied to the former's mandrel.

In this Example, the contact zone between the charging roller and the electrophotographic photosensitive member was in a width of 3 mm. The charging roller was rotatingly driven at about 1.33 Hz in the clockwise direction shown by an arrow (FIG. 4). On other words, the charging roller was so driven that its surface moved with a velocity difference in respect to the surface of the electrophotographic photosensitive member.

As the charging particles, conductive zinc oxide particles with a volume resistivity of $10^6$ Ω·cm and an average particle diameter of 3 μm inclusive of that of secondary agglomerates were used. Also, as a means for feeding the charging particles, as shown in FIG. 4, construction was employed in which the control blade 34 was brought into contact with the charging roller 32 and the charging particles 33 were held between the charging roller 32 and the control blade 34. Thus, the charging particles 33 are coated in a constant quantity on the charging roller 32 as the electrophotographic photosensitive member 31 is rotated.

Voltage applied to the charging roller was only DC, which was set to be −600 V. Here, dark-area potential Vd of the electrophotographic photosensitive member was −580 V.

A cleaning blade was also detached so as to carry out the cleanerless process so that the residual toner and so forth remaining after transfer were collected in the developing assembly.

The results are shown in Table 1.

EXAMPLES 3 AND 4

Figure 7:
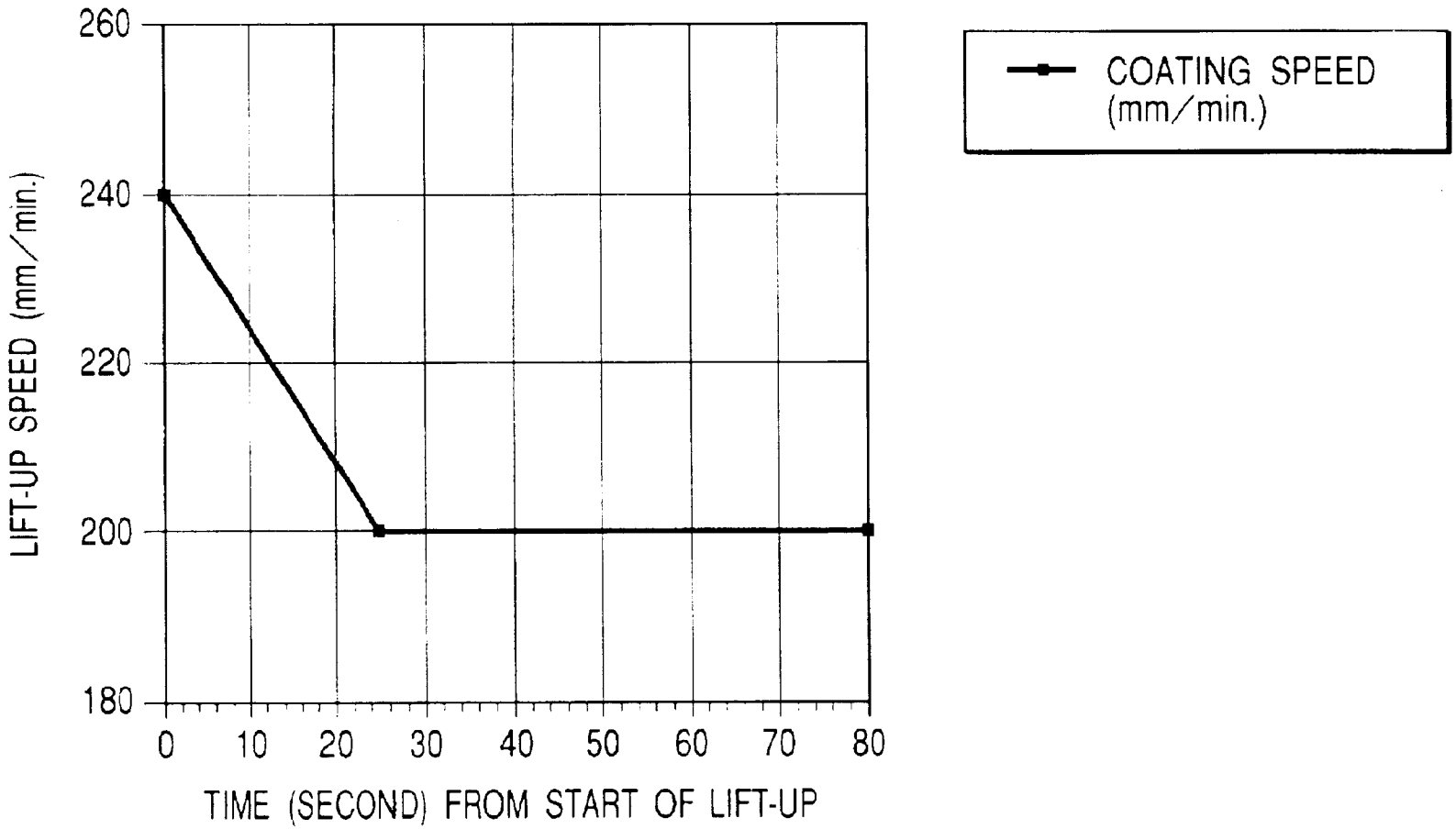
FIG. 7 is a graph showing changes in the rate of lift-up of a cylindrical support in respect to the lapse of time in a case in which a protective layer is formed by coating.

Electrophotographic photosensitive members were produced in the same manner as in Examples 1 and 2, respectively, except that the binder resin phenolic resin of the protective layer was changed for methylphenylpolysiloxane (trade name: KF-50700CS; available from Shin-Etsu Chemical Industry Co., Ltd.), the fine polytetrafluoroethylene particles were change for small-diameter silicone resin particles (average particle diameter: 0.2 μm) and, when the protective layer was formed by dip coating, as shown in FIG. 7, the lift-up speed of the cylinder was set at 240 mm/minute at the initial stage and thereafter the speed was so changed as to become gradually lower to come to 200 mm/minute after 25 seconds and was thereafter kept constant at 200 mm/minute until the coating was completed. Evaluation was made in the same way. The results are shown in Table 1.

Here, the layer thickness of the protective layer was found to be 2.08 μm, 2.12 μm, 2.15 μm, 2.17 μm, 2.18 μm and 2.20 μm (the middle portion) at the same positions as those in Examples 1 and 2.

EXAMPLES 5 AND 6

Electrophotographic photosensitive members were produced in the same manner as in Examples 3 and 4, respectively, except that the solid content of the protective layer liquid preparation 2 was changed to 22.2% and, when the protective layer was formed by dip coating, the lift-up speed of the cylinder was set at 290 mm/minute at the initial stage and thereafter the speed was so changed as to become gradually lower to come to 250 mm/minute after 25 seconds and was thereafter kept constant at 250 mm/minute until the coating was completed. Evaluation was made in the same way. The results are shown in Table 1.

The layer thickness of the protective layer was found to be 1.49 μm, 1.69 μm, 1.80 μm, 1.90 μm, 1.97 μm and 2.05 μm (the middle portion) at the same positions as those in Examples 3 and 4.

EXAMPLES 7 AND 8

Electrophotographic photosensitive members were produced in the same manner as in Examples 3 and 4, respectively, except that, when the protective layer was formed by dip coating, the lift-up speed of the cylinder was set at 240 mm/minute at the initial stage, kept at 240 mm/minute for the following 15 seconds and thereafter kept constant at 200 mm/minute until the coating was completed. Evaluation was made in the same way. The results are shown in Table 1.

The layer thickness of the protective layer was found to be 2.11 μm, 2.14 μm, 2.16 μm, 2.17 μm, 2.18 μm and 2.20 μm (the middle portion) at the same positions as those in Examples 3 and 4.

EXAMPLES 9 AND 10

Electrophotographic photosensitive members were produced in the same manner as in Examples 7 and 8, respectively, except that, when the protective layer was formed by dip coating, the lift-up speed of the cylinder was set at 270 mm/minute at the initial stage and thereafter the speed was so changed as to become gradually lower to come to 250 mm/minute after 25 seconds and was thereafter kept constant at 250 mm/minute until the coating was completed. Evaluation was made in the same way. The results are shown in Table 1.

The layer thickness of the protective layer was found to be 1.27 μm, 1.53 μm, 1.68 μm, 1.82 μm, 1.94 μm and 2.05 μm (the middle portion) at the same positions as those in Examples 7 and 8.

Comparative Examples 1 and 2

Electrophotographic photosensitive members were produced in the same manner as in Examples 5 and 6, respectively, except that, when the protective layer was formed by dip coating, the lift-up speed of the cylinder was kept constant at 250 mm/minute. Evaluation was made in the same way. The results are shown in Table 1.

The layer thickness of the protective layer was found to be 1.15 μm, 1.43 μm, 1.58 μm, 1.75 μm, 1.92 μm and 2.05 μm (the middle portion) at the same positions as those in Examples 5 and 6.

Comparative Examples 3 and 4

Electrophotographic photosensitive members were produced in the same manner as in Examples 3 and 4, respectively, except that the charge transport layer and the protective layer were formed in the following way. Evaluation was made in the same way.

First, the aluminum cylinder as the conductive support, having a length of 261 mm, was changed for one having a larger length of 359 mm.

The dip coating for the charge transport layer was also carried out by making the cylinder begin to be immersed from its lower end, immersing it up to a position of 100 mm from its upper end, and then lifting it up from that position in the same manner as in Example 3. The dip coating for the protective layer was further carried out by making the cylinder begin to be immersed from its lower end, immersing it up to a position of 2 mm from its upper end, and then lifting it up from that position at a constant speed of 200 mm/minute.

The electrophotographic photosensitive members thus obtained were each cut at the part where the charge transport layer was not formed and at a position of 98 mm from the upper end of the cylinder, to have a length of 261 mm.

The layer thickness of the charge transport layer was found to be 17.1 μm, 18.1 μm, 18.8 μm, 19.3 μm, 19.8 μm and 20.2 μm (the middle portion) at the same positions as those in Example 3. Similarly, the layer thickness of the protective layer was found to be 2.19 μm, 2.19 μm, 2.19 μm, 2.20 μm, 2.20 μm and 2.20 μm (the middle portion).

The results are shown in Table 1.

EXAMPLE 11

An electrophotographic photosensitive member was produced in the same manner as in Example 1 except that the binder resin used in the charge transport layer was changed for 12 parts of bisphenol-Z polycarbonate (trade name: IUPILON Z-400; available from Mitsubishi Gas Chemical Company, Inc.) and the protective layer was formed in the following way. Evaluation was made in the same way.

30 parts of the compound shown as Exemplary Compound No. 8 as a charge-transporting material and as a resin component 30 parts of resol type phenolic resin (trade name: PL-4852; containing an amine compound; available from Gun-ei Chemical Industry Co., Ltd.) were dissolved in 220 parts of ethanol to prepare a protective layer liquid preparation 3. Then, a liquid dispersion prepared by dispersing 20 parts of fine polytetrafluoroethylene particles (average particle diameter: 0.18 μm) in 20 parts of ethanol by means of a microfluidizer was further added to the liquid preparation 3 to prepare a liquid preparation 4.

Using this liquid preparation 4, the protective layer was formed by dip coating, where the lift-up speed of the cylinder was kept constant at 230 mm/minute for a period of from the initial stage to 10 seconds, kept at 210 mm/minute for the following 10 seconds and thereafter kept constant at 200 mm/minute until the coating was completed.

The layer thickness of the charge transport layer was found to be 15.3 μm, 16.5 μm, 17.1 μm, 17.5 μm, 17.7 μm and 18.2 μm (the middle portion) at the same positions as those in Example 1. Similarly, the layer thickness of the protective layer was found to be 2.94 μm, 3.01 μm, 3.05 μm, 3.07 μm, 3.09 μm and 3.12 μm (the middle portion).

The results are shown in Table 1.

EXAMPLE 12

An electrophotographic photosensitive member was produced in the same manner as in Example 11 except that the resol type phenolic resin PL-4852 was changed for resol type phenolic resin PL-5294 (trade name; containing an alkali metal; available from Gun-ei Chemical Industry Co., Ltd.). Evaluation was made in the same way. The results are shown in Table 1.

The layer thickness of the protective layer was found to be 2.27 μm, 2.57 μm, 2.76 μm, 2.89 μm, 3.00 μm and 3.12 μm (the middle portion) at the same positions as those in Example 11.

EXAMPLE 13

An electrophotographic photosensitive member was produced in the same manner as in Example 11 except that the binder resin of the protective layer was changed for an epoxy resin and further the fine polytetrafluoroethylene particles were changed for fine alumina particles (average particle diameter: 0.2 μm). Evaluation was made in the same way. The results are shown in Table 1.

The layer thickness of the protective layer was found to be 3.74 μm, 3.80 μm, 3.82 μm, 3.85 μm, 3.87 μm and 3.92 μm (the middle portion) at the same positions as those in Example 11.

EXAMPLE 14

An electrophotographic photosensitive member was produced in the same manner as in Example 11 except that the protective layer was formed in the following way. Evaluation was made in the same way.

The binder resin of the protective layer was changed for polyurethane resin (trade name: RETHANE6000; available from Kansai Paint Co., Ltd.) and the solvent was changed for THF, 3.5 parts of COLONATE HL (trade name; available from Nippon Polyurethane Industry Co., Ltd.) was added as a curing agent and further the fine polytetrafluoroethylene particles were changed for fine silicone particles (average particle diameter: 0.25 μm) and 50 parts of THF was added to prepare a protective layer liquid preparation.

Using this liquid preparation, the protective layer was formed by dip coating, where the lift-up speed of the cylinder was set at 250 mm/minute at the initial stage and thereafter the speed was so changed as to become gradually lower to come to 200 mm/minute after 60 seconds and was thereafter kept constant at 200 mm/minute until the coating was completed.

The layer thickness of the protective layer was found to be 3.27 μm, 4.10 μm, 4.57 μm, 4.89 μm, 5.06 μm and 5.50 μm (the middle portion) at the same positions as those in Example 11.

The results are shown in Table 1.

Comparative Example 5

An electrophotographic photosensitive member was produced in the same manner as in Example 14 except that, when the protective layer was formed by dip coating, the lift-up speed of the cylinder was set at 170 mm/minute at the initial stage and thereafter the speed was so changed as to become gradually higher to come to 190 mm/minute after 40 seconds and was thereafter kept constant at 200 mm/minute until the coating was completed. Evaluation was made in the same way. The results are shown in Table 1.

The layer thickness of the protective layer was found to be 3.01 μm, 3.85 μm, 4.23 μm, 4.56 μm, 4.95 μm and 5.50 μm (the middle portion) at the same positions as those in Example 11.

Comparative Example 6

An electrophotographic photosensitive member was produced in the same manner as in Example 13 except that the charge transport layer and the protective layer were formed in the following way. Evaluation was made in the same way.

First, the aluminum cylinder as the conductive support, having a length of 261 mm, was changed for one having a larger length of 359 mm.

The dip coating for the charge transport layer was also carried out by making the cylinder begin to be immersed from its lower end, immersing it up to a position of 100 mm from its upper end, and then lifting it up from that position in the same manner as in Example 13. The dip coating for the protective layer was further carried out by making the cylinder begin to be immersed from its lower end, immersing it up to a position of 2 mm from its upper end, and then lifting it up from that position at a constant speed of 200 mm/minute.

The electrophotographic photosensitive member thus obtained was cut at the part where the charge transport layer was not formed and at a position of 98 mm from the upper end of the cylinder, to have a length of 261 mm.

The layer thickness of the charge transport layer was found to be 15.1 μm, 16.2 μm, 16.9 μm, 17.2 μm, 17.4 μm and 18.2 μm (the middle portion) at the same positions as those in Example 13. Similarly, the layer thickness of the protective layer was found to be 3.89 μm, 3.89 μm, 3.90 μm, 3.91 μm, 3.91 μm and 3.92 μm (the middle portion).

The results are shown in Table 1.

Comparative Example 7

An electrophotographic photosensitive member was produced in the same manner as in Example 11 except that the protective layer was not formed. Evaluation was made in the same way. The results are shown in Table 1.

EXAMPLE 15

An electrophotographic photosensitive member was produced in the same manner as in Example 11 except that the charge-transporting material Exemplary Compound No. 8 used in the protective layer was changed for Exemplary Compound No. 18. Evaluation was made in the same way. The results are shown in Table 1.

The layer thickness of the protective layer was found to be 2.85 μm, 2.91 μm, 2.95 μm, 2.98 μm, 3.00 μm and 3.12 μm (the middle portion) at the same positions as those in Example 11.

EXAMPLE 16

An electrophotographic photosensitive member was produced in the same manner as in Example 11 except that the charge-transporting material Exemplary Compound No. 8 used in the protective layer was changed for Exemplary Compound No. 27 and, when the protective layer was formed by dip coating, the lift-up speed of the cylinder was set at 250 mm/minute at the initial stage and was kept constant at 250 mm/minute for the following 5 seconds and thereafter the speed was so changed as to become gradually lower to come to 200 mm/minute after 60 seconds and was thereafter kept constant at 200 mm/minute until the coating was completed. Evaluation was made in the same way. The results are shown in Table 1.

The layer thickness of the protective layer was found to be 3.52 μm, 3.69 μm, 3.75 μm, 3.80 μm, 3.85 μm and 3.92 μm (the middle portion) at the same positions as those in Example 11.

EXAMPLE 17

An electrophotographic photosensitive member was produced in the same manner as in Example 11 except that the charge-transporting material Exemplary Compound No. 8 used in the protective layer was changed for Exemplary Compound No. 36 and, when the protective layer was formed by dip coating, the lift-up speed of the cylinder was set at 230 mm/minute at the initial stage, kept constant at 230 mm/minute for the following 20 seconds and thereafter kept constant at 210 mm/minute until the coating was completed. Evaluation was made in the same way. The results are shown in Table 1.

The layer thickness of the protective layer was found to be 3.23 μm, 3.38 μm, 3.40 μm, 3.42 μm, 3.45 μm and 3.53 μm (the middle portion) at the same positions as those in Example 11.

EXAMPLE 18

An electrophotographic photosensitive member was produced in the same manner as in Example 17 except that the charge-transporting material Exemplary Compound No. 36 used in the protective layer was changed for Exemplary Compound No. 47. Evaluation was made in the same way. The results are shown in Table 1.

The layer thickness of the protective layer was found to be 3.15 μm, 3.25 μm, 3.35 μm, 3.45 μm, 3.55 μm and 3.62 μm (the middle portion) at the same positions as those in Example 17.

EXAMPLE 19

An electrophotographic photosensitive member was produced in the same manner as in Example 17 except that the charge-transporting material Exemplary Compound No. 36 used in the protective layer was changed for Exemplary Compound No. 57. Evaluation was made in the same way. The results are shown in Table 1.

The layer thickness of the protective layer was found to be 3.02 μm, 3.15 μm, 3.24 μm, 3.30 μm, 3.35 μm and 3.42 μm (the middle portion) at the same positions as those in Example 17.

TABLE 1

| | With regard to: | | Image evaluation | |
|---|---|---|---|---|
| | Expn. (1) | Expn. (2) | Initial stage | After 5,000-sheet running |
| Example: | | | | |
| 1 | Within the range. | Within the range. | Good. | Good. |
| 2 | Within the range. | Within the range. | Good. | Good. |
| 3 | Within the range. | Within the range. | Good. | Good. |
| 4 | Within the range. | Within the range. | Good. | Good. |
| 5 | Within the range. | Within the range. | Good. | Good. |
| 6 | Within the range. | Within the range. | Good. | Good. |
| 7 | Within the range. | Outside the range (over the upper limit). | Good. | A little low density at the end portion. |
| 8 | Within the range. | Outside the range (over the upper limit). | Good. | A little low density at the end portion. |
| 9 | Within the range. | Outside the range (below the lower limit). | Good. | A little high density at the end portion. |
| 10 | Within the range. | Outside the range (below the lower limit). | Good. | A little high density at the end portion. |
| 11 | Within the range. | Within the range. | Good. | Good. |
| 12 | Within the range. | Within the range. | Good. | Good. |
| 13 | Within the range. | Outside the range (over the upper limit). | Good. | A little low density at the end portibn. |
| 14 | Within the range. | Outside the range (below the lower limit). | Good. | A little high density at the end portion. |
| 15 | Within the range. | Within the range. | Good. | Good. |
| 16 | Within the range. | Within the range. | Good. | Good. |
| 17 | Within the range. | Within the range. | Good. | Good. |
| 18 | Within the range. | Within the range. | Good. | Good. |
| 19 | Within the range. | Within the range. | Good. | Good. |
| Comparative Example: | | | | |
| 1 | Outside the range (below the lower limit). | Outside the range (below the lower limit). | A little high density at the end portion. | High density at the end portion. |
| 2 | Outside the range (below the lower limit). | Outside the range (below the lower limit). | A little high density at the end portion. | High density at the end portion. |

TABLE 1-continued

| | With regard to: | | Image evaluation | |
|---|---|---|---|---|
| | Expn. (1) | Expn. (2) | Initial stage | After 5,000-sheet running |
| 3 | Outside the range (over the upper limit). | Outside the range (over the upper limit). | A little low density at the end portion. | Low density at the end portion. |
| 4 | Outside the range (over the upper limit). | Outside the range (over the upper limit). | A little low density at the end portion. | Low density at the end portion. |
| 5 | Outside the range (below the lower limit). | Outside the range (below the lower limit). | A little high density at the end portion. | High density at the end portion. |
| 6 | Outside the range (over the upper limit). | Outside the range (over the upper limit). | A little low density at the end portion. | Low density at the end portion. |
| 7 | — | — | A little low density at the end portion. | Abraded greatly at the end portion. and poor. |

As described above, the present invention has made it possible to provide an electrophotographic photosensitive member which can highly stably obtain good images without even any slight difference in image density so as to be able to deal with any future achievement of much higher image quality, and to provide a process cartridge and an electrophotographic apparatus which have such an electrophotographic photosensitive member.

What is claimed is:

1. An electrophotographic photosensitive member comprising a conductive support, and provided thereon a charge generation layer, a charge transport layer and a protective layer in this order, wherein;

the layer thickness $a_0$ ($\mu$m) of said charge transport layer at the middle portion of said conductive support in its generatrix direction, the layer thickness $b_0$ ($\mu$m) of said protective layer at the middle portion of said conductive support in its generatrix direction, the layer thickness a ($\mu$m) of said charge transport layer at a portion other than the middle portion and the layer thickness b ($\mu$m) of said protective layer at the portion other than the middle portion satisfy the following expression (1) in a region satisfying 0.8 ($\mu$m)$\leqq(a_0-a)\leqq$3.0 ($\mu$m):

$$b_0\times(a/a_0)^3\leqq b(\mu\text{m})\leqq b_0\times(a/a_0)^{1/4} \quad (1).$$

wherein said $a_0$ ($\mu$m) is from 5 $\mu$m to 40 $\mu$m and said $b_0$ ($\mu$m) is from 0.5 $\mu$m to 5.5 $\mu$m.

2. An electrophotographic photosensitive member according to claim 1, wherein said $a_0$ ($\mu$m), $b_0$ ($\mu$m), a ($\mu$m) and b ($\mu$m) satisfy the following expression (2) in the region satisfying 0.8 ($\mu$m)$\leqq(a_0-a)\leqq$3.0 ($\mu$m):

$$b_0\times(a/a_0)^2\leqq b(\mu\text{m})\leqq b_0\times(a/a_0)^{1/3} \quad (2).$$

3. An electrophotographic photosensitive member according to claim 1, wherein said $a_0$ ($\mu$m) and a ($\mu$m) satisfy the following expression (3) in a developing-region width:

$$0.5(\mu\text{m})\leqq(a_0-a) \quad (3).$$

4. An electrophotographic photosensitive member according to claim 1, wherein said protective layer contains a binder resin and at least one of conductive particles and a charge-transporting material.

5. An electrophotographic photosensitive member according to claim 4, wherein said binder resin is a curable resin.

6. An electrophotographic photosensitive member according to claim 5, wherein said curable resin is a phenolic resin.

7. An electrophotographic photosensitive member according to claim 4, wherein said charge-transporting material is a compound having at least one hydroxyl group in the molecule.

8. An electrophotographic photosensitive member according to claim 7, wherein said hydroxyl group is a hydroxyalkyl group, a hydroxyalkoxyl group or a hydroxyphenyl group.

9. An electrophotographic photosensitive member according to claim 8, wherein the compound having at least one hydroxyalkyl group, hydroxyalkoxyl group or hydroxyphenyl group is represented by any of the following Formulas (2) to (7):

(2)

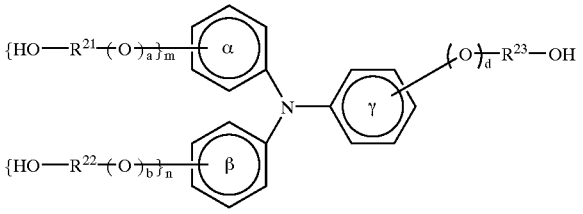

wherein $R^{21}$, $R^{22}$ and $R^{23}$ each independently represent a divalent hydrocarbon group having 1 to 8 carbon atoms and which may be branched; the benzene rings α, β and γ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; and letter symbols a, b, d, m and n each independently represent 0 or 1;

(3)

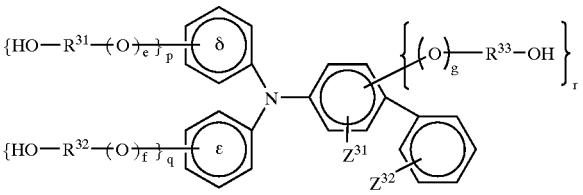

wherein $R^{31}$, $R^{32}$ and $R^{33}$ each independently represent a divalent hydrocarbon group having 1 to 8 carbon atoms and which may be branched; the benzene rings δ and ε may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; letter symbols e, f and g each independently represent 0 or 1; letter symbols p, q and r each independently represent 0 or 1, provided that a case in which all of them are simultaneously 0 is excluded; and $Z^{31}$ and $Z^{32}$ each independently represent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may combine to form a ring;

(4)

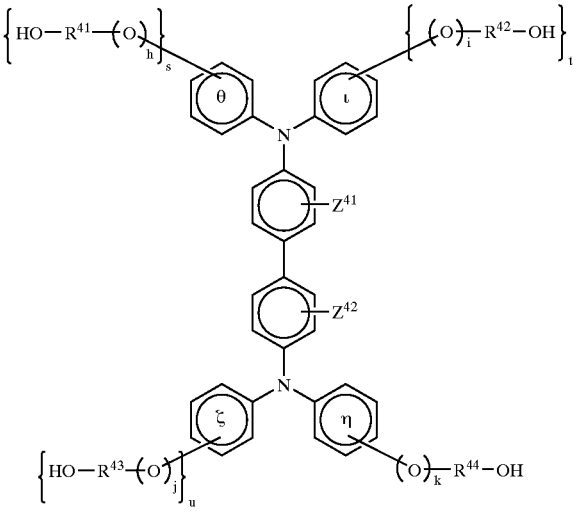

wherein $R^{41}$, $R^{42}$, $R^{43}$ and $R^{44}$ each independently represent a divalent hydrocarbon group having 1 to 8 carbon atoms and which may be branched; the benzene rings ζ, η, θ and ι may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; letter symbols h, i, j, k, s, t and u each independently represent 0 or 1; and $Z^{41}$ and $Z^{42}$ each independently represent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may combine to form a ring;

(5)

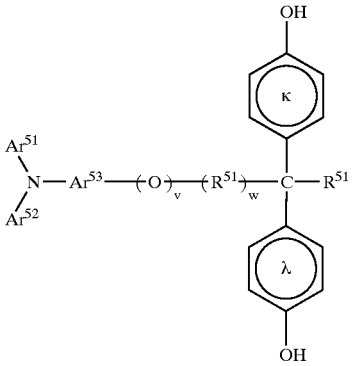

wherein $R^{51}$ represents a divalent hydrocarbon group having 1 to 8 carbon atoms and which may be branched; $R^{52}$ represents a hydrogen atom, a substituted or unsubstituted alkyl group, a substituted or unsubstituted aralkyl group or a substituted or unsubstituted phenyl group; $Ar^{51}$ and $Ar^{52}$ each independently represent a substituted or unsubstituted alkyl group, a substituted or unsubstituted aralkyl group, a substituted or unsubstituted aromatic hydrocarbon ring group or a substituted or unsubstituted aromatic heterocyclic group; $Ar^{53}$ represents a substituted or unsubstituted divalent aromatic hydrocarbon ring group or a substituted or unsubstituted divalent aromatic heterocyclic group; letter symbols v and w each independently represent 0 or 1, provided that w is 0 when v is 0; and the benzene rings κ and λ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group;

(6)

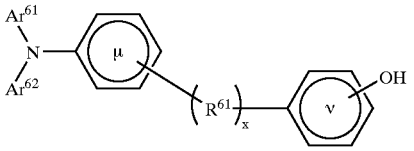

wherein $R^{61}$ represents a divalent hydrocarbon group having 1 to 8 carbon atoms and which may be branched; $Ar^{61}$ and $Ar^{62}$ each independently represent a substituted or unsubstituted alkyl group, a substituted or unsubstituted aralkyl group, a substituted or unsubstituted aromatic hydrocarbon ring group or a substituted or unsubstituted aromatic heterocyclic group; letter symbol x represents 0 or 1; and the benzene rings μ and ν may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or the benzene rings μ and ν may combine via a substituent to form a ring; and (7)

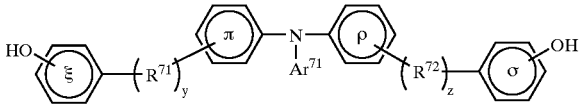

wherein $R^{71}$ and $R^{72}$ each independently represent a divalent hydrocarbon group having 1 to 8 carbon atoms and which may be branched; $Ar^{71}$ represents a substituted or unsubstituted alkyl group, a substituted or unsubstituted aralkyl group, a substituted or unsubstituted aromatic hydrocarbon ring group or a substituted or unsubstituted aromatic heterocyclic group; letter symbols y and z each independently represent 0 or 1; and the benzene rings ξ, π, ρ and σ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; or the benzene rings ξ and π and the benzene rings ρ and σ may each independently combine via a substituent to form a ring.

10. A process cartridge comprising an electrophotographic photosensitive member and a charging means; said electrophotographic photosensitive member and said charging means being integrally supported; said process cartridge being detachably mountable to the main body of an electrophotographic apparatus;

said electrophotographic photosensitive member comprising a conductive support, and provided thereon a charge generation layer, a charge transport layer and a protective layer in this order, wherein;

the layer thickness $a_0$ (μm) of said charge transport layer at the middle portion of said conductive support in its generatrix direction, the layer thickness $b_0$ (μm) of said protective layer at the middle portion of said conductive support in its generatrix direction, the layer thickness a (μm) of said charge transport layer at a portion other than the middle portion and the layer thickness b (μm) of said protective layer at the portion other than the middle portion satisfy the following expression (1) in a region satisfying 0.8 (μm)≦($a_0$−a)≦3.0 (μm):

$$b_0\times(a/a_0)^3 \leqq b(\mu m) \leqq b_0\times(a/a_0)^{1/4} \quad (1).$$

wherein said $a_0$ (μm) is from 5 μm to 40 μm and said $b_0$ (μm) is from 0.5 μm to 5.5 μm.

11. An electrophotographic apparatus comprising an electrophotographic photosensitive member, a charging means, an exposure means, a developing means and a transfer means;

said electrophotographic photosensitive member comprising a conductive support, and provided thereon a charge generation layer, a charge transport layer and a protective layer in this order, wherein;

the layer thickness $a_0$ (μm) of said charge transport layer at the middle portion of said conductive support in its generatrix direction, the layer thickness $b_0$ (μm) of said protective layer at the middle portion of said conductive support in its generatrix direction, the layer thickness a (μm) of said charge transport layer at a portion other than the middle portion and the layer thickness b (μm) of said protective layer at the portion other than the middle portion satisfy the following expression (1) in a region satisfying 0.8 (μm)≦($a_0$−a)≦3.0 (μm):

$$b_0\times(a/a_0)^3 \leqq b(\mu m) \leqq b_0\times(a/a_0)^{1/4} \quad (1).$$

wherein said $a_0$ (μm) is from 5 μm to 40 μm and said $b_0$ (μm) is from 0.5 μm to 5.5 μm.

* * * * *

UNITED STATES PATENT AND TRADEMARK OFFICE

CERTIFICATE OF CORRECTION

PATENT NO. : 6,815,135 B2 
DATED : November 9, 2004
INVENTOR(S) : Yosuke Morikawa et al.

It is certified that error appears in the above-identified patent and that said Letters Patent is hereby corrected as shown below:

Column 8,
Line 36, "$C_8F_{13}CONHSi(OCH_3)_3$" should read -- $C_6F_{13}CONHSi(OCH_3)_3$ --; and
Line 38, "$C_7F_{16}CONHCH_2CH_2CH_2Si(OC_2H_5)_3$" should read
-- $C_7F_{15}CONHCH_2CH_2CH_2Si(OC_2H_5)_3$ --.

Column 25,

No. 35, " 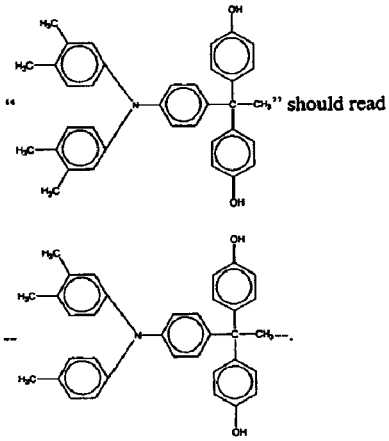 " should read

Column 47,
Line 5, "VI (V)" should read -- V1 (V) --

Column 53,
Line 43, "portibn." should read -- portion. --

Signed and Sealed this

Third Day of May, 2005

JON W. DUDAS
*Director of the United States Patent and Trademark Office*